US006731265B1

(12) United States Patent
Kokuhata et al.

(10) Patent No.: US 6,731,265 B1
(45) **Date of Patent: *May 4, 2004**

(54) DISPLAY APPARATUS AND METHOD FOR DRIVING THE SAME

(75) Inventors: Yoshiyuki Kokuhata, Nara (JP); Masahiro Takahashi, Tenri (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,230

(22) Filed: Mar. 25, 1998

(30) Foreign Application Priority Data

Mar. 27, 1997 (JP) ..... 9-076326

(51) Int. Cl.[7] ..... G09G 3/36
(52) U.S. Cl. ..... 345/101; 345/95; 345/98
(58) Field of Search ..... 345/87, 89, 90, 345/95, 98, 100, 101–102; 349/72

(56) References Cited

U.S. PATENT DOCUMENTS 5,041,821 A * 8/1991 Onitsuka et al. ..... 340/748
5,157,525 A * 10/1992 Eaton et al. ..... 345/87
5,317,332 A * 5/1994 Kanno et al. ..... 345/101
5,414,441 A * 5/1995 Memarzadeh et al. ..... 345/101
5,608,422 A * 3/1997 Ikeda ..... 345/101
5,621,306 A 4/1997 Ise ..... 323/313
5,739,816 A * 4/1998 Kobayashi et al. ..... 345/98
5,936,604 A * 8/1999 Endou ..... 345/88
6,115,021 A * 9/2000 Nonomura et al. ..... 345/101
6,414,664 B1 * 7/2002 Conover et al. ..... 345/89

FOREIGN PATENT DOCUMENTS

| | | |
|---|---|---|
| JP | 03-036519 | 2/1991 |
| JP | 5-52886 | 7/1993 |
| JP | 5-307169 A | 11/1993 |
| JP | 7-141039 A | 7/1995 |
| JP | 07-270752 | 10/1995 |
| JP | 07-318904 | 12/1995 |

* cited by examiner

*Primary Examiner*—Richard Hjerpe
*Assistant Examiner*—Duc Q Dinh
(74) *Attorney, Agent, or Firm*—Nixon & Vanderhye, PC

(57) ABSTRACT

A method for driving a liquid crystal display apparatus including pixels, scanning lines, and data lines, includes the steps of: generating a data signal voltage to be applied to the data lines from a supply voltage; and correcting the supply voltage based on a temperature of the liquid crystal display apparatus.

32 Claims, 27 Drawing Sheets

PRIOR ART

PRIOR ART

PRIOR ART

PRIOR ART

PRIOR ART

PRIOR ART

PRIOR ART

PRIOR ART

DISPLAY APPARATUS AND METHOD FOR DRIVING THE SAME

BACKGROUND OF THE INVENTION

1. Field of the Invention

The present invention relates to a display apparatus and a method for driving the same, and more particularly to a display apparatus such as a liquid crystal display apparatus, for example, used for audio visual (AV) equipment, office automation (OA), etc., which uses a voltage generating device forming a part of a driving device and a method for driving the same.

2. Description of the Related Art

FIG. 23 shows an example of the liquid crystal display apparatus as described above. The liquid crystal display apparatus includes a display panel 1001 which performs a display function, a scanning electrode signal driver 1002 for applying a predetermined voltage to scanning electrode lines $Y_1$ to $Y_m$ of the display panel 1001 in a line sequence, and a data electrode signal driver 1003 for applying a predetermined voltage to data electrode lines $X_1$ to $X_n$ of the display panel 1001 in accordance with display information. In addition, the apparatus includes a voltage generating section 1006 for generating a voltage applied to the scanning electrode signal driver 1002 and the data electrode signal driver 1003, and a control section 1005 which receives information from an input signal line 1004 to send a control signal to the scanning electrode signal driver 1002, the data electrode signal driver 1003, and the voltage generating section 1006, respectively.

The voltage generating section 1006 includes a data signal voltage generating circuit 1101, a non-selection voltage generating circuit 1102, and a write voltage generating circuit 1103, as shown in FIG. 24.

The voltage generating section 1006 receives a logic circuit power-supply voltage $V_{cc}$, a supply voltage $V_{ee}$, and a control signal $S_d$. Alternatively, the supply voltage $V_{ee}$ may not be input to the voltage generating section 1006; in such a case, a supply voltage is generated by a booster circuit, etc. in the voltage generating section 1006 based on the logic circuit power-supply voltage $V_{cc}$. The voltage generating section 1006 generates a data signal voltage VD, a non-selection voltage VM, a positive electrode side write voltage VH, and a negative electrode side write voltage VL based on input signals such as the logic circuit power-supply voltage $V_{cc}$, the supply voltage $V_{ee}$, and the control signal $S_d$.

The data signal voltage VD, the non-selection voltage VM, and the write voltages VH and VL satisfy the following Expressions (1) and (2):

$$VD=2\times VM \tag{1}$$

$$|VL|=|VH|-|VD| \tag{2}$$

As shown in FIG. 21, the display panel 1101 has a simple matrix type structure in which pixels are arranged in a matrix. Each pixel is composed of one of the scanning electrode lines $Y_1$ to $Y_m$, one of the data electrode lines $X_1$ to $X_n$, and the liquid crystal 1201 provided between the electrode lines.

Referring back to prior art FIG. 23, the scanning electrode signal driver 1002 is composed of a shift register, an analog switch, etc., and the data electrode signal driver 1003 is composed of a shift register, a latch circuit, an analog switch, etc.

FIG. 25 shows an exemplary operation of the scanning electrode signal driver 1002. It is noted that the scanning electrode signal driver 1002 applies a predetermined voltage to the scanning electrode lines $Y_1$ to $Y_m$ in accordance with a latch pulse LP and an alternating signal M.

The scanning electrode signal driver 1002 receives a scanning commencement signal S (not shown), the latch pulse LP, the alternating signal M, and various voltages 1305 (i.e., the write voltages VH and VL, the non-selection voltage VM, and a reference voltage VS) from the control section 1005. The reference voltage VS is generally 0 volt, so that it may be omitted hereinafter. The scanning electrode signal driver 1002 applies the positive electrode side write voltage VH or the negative electrode side write voltage VL supplied from the voltage generating section 1006 to a selected line during a selection period, and the non-selection voltage VM to the selected line during a non-selection period.

Furthermore, FIG. 25 shows waveforms 1306 and 1307 of voltages applied to the scanning electrode lines $Y_i$ and $Y_{i+1}$. As represented by the waveform 1306, during a selection period 1303 in an A frame 1301, the write voltage VH is applied to the scanning electrode line $Y_i$ in accordance with the latch pulse LP and the alternating signal M. During a selection period 1304 in a B frame 1302, the write voltage VL is applied to the scanning electrode line $Y_i$ in accordance with the latch pulse LP and the alternating signal M, and during a non-selection period, the non-selection voltage VM is applied to the scanning electrode line $Y_i$. On the other hand, as represented by the waveform 1307, during a selection period 1308 in the A frame 1301, the write voltage VL is applied to the scanning electrode line $Y_{i+1}$ in accordance with the latch pulse LP and the alternating signal M. During a selection period 1309 in the B frame 1302, the write voltage VH is applied to the scanning electrode line $Y_{i+1}$, and during the non-selection period, the non-selection voltage VM is applied to the scanning electrode line $Y_{i+1}$ in accordance with the latch pulse LP and the alternating signal M. Herein, the A+B frames each refer to one period of the scanning commencement signal S, and the non-selection period refers to a period obtained by excluding the selection periods from one frame.

FIG. 26 shows signals which are transmitted to the data electrode signal driver 1003. The data electrode signal driver 1003 receives the latch pulse LP, the alternating signal M, a data signal D, and a data transfer clock signal CLK from the control section 1005. Data of each data electrode line $X_j$ is determined based on the data signal D and the data transfer clock signal CLK.

FIG. 27 shows an exemplary operation of the data electrode signal driver 1003. The data electrode signal driver 1003 receives the data signal voltage VD, the non-selection voltage VM, and the reference voltage VS, in addition to the above-mentioned signals, from the voltage generating section 1006.

The data electrode signal driver 1003 applies the latch pulse LP, the alternating signal M, and the data signal transmitted from the control section 1005 and the data signal voltage VD or the reference voltage VS transmitted from the voltage generating section 1006 to a selected line. For example, in the case where data $DX_j$ of the data electrode line $X_j$ is at a high level as represented by reference numeral 1509, the data electrode line $X_j$ is supplied with a voltage represented by a waveform 1506 in accordance with the latch pulse LP and the alternating signal M. Reference numeral 1507 shows a waveform of a voltage applied to the scanning electrode line $Y_i$. Thus, a waveform applied to a pixel at a coordinate $(X_j, Y_i)$ is as represented by reference numeral 1508.

In a general liquid crystal display apparatus, the data signal voltage VD is constant irrespective of an ambient temperature or the like, as shown in FIG. 27. FIG. 28 shows contrast-supply voltage characteristics at each temperature when the data signal voltage VD is constant.

In FIG. 28, a curve 1603 represents a contrast-supply voltage characteristic at $T_a$=0° C., where $T_a$ is a temperature of a liquid crystal display apparatus; a curve 1602 represents a contrast-supply voltage characteristic at $T_a$=25° C.; and a curve 1601 represents a contrast-supply voltage characteristic at $T_a$=50° C.

As is understood from FIG. 28, if a use temperature of the liquid crystal display apparatus is in a range of 0° C. to 50° C., it is required to vary a supply voltage for the liquid crystal driving circuit between $V_{a1}$ and $V_{c1}$ in order to improve the contrast of the apparatus. Furthermore, in the case where the temperature dependence of the liquid crystal display apparatus is larger than that shown in FIG. 28, the range of variation of the supply voltage which is a power-supply voltage for a liquid crystal driving circuit is required to be made even larger.

FIG. 29 shows a conventional circuit for generating a power-supply voltage for a liquid crystal driving circuit which is capable of varying a voltage. The voltage generating circuit shown in FIG. 29 includes a variable voltage regulator 1701, resistors 1702 and 1703, a capacitor 1704, electrolytic capacitors 1705 and 1706, and diodes 1707 and 1708.

An input voltage $V_{in}$ is adjusted by the variable voltage regulator 1701, whereby an adjusted supply voltage $V_{ee}$ is obtained. The input voltage $V_{in}$ is required to be higher than the supply voltage $V_{ee}$ as a power-supply voltage for a liquid crystal driving circuit. In general, the input voltage $V_{in}$ is constant.

Thus, in the voltage generating circuit shown in FIG. 29, when an optimum voltage $V_{c1}$ of the curve 1603 shown in FIG. 28 becomes high, the input voltage $V_{in}$ is required to be set to a high value. Consequently, the withstanding voltage of the variable voltage regulator 1701 is required to be set to a high value.

As the potential difference between the optimum voltage $V_{a1}$ of the curve 1601 and the optimum voltage $V_{c1}$ of the curve 1603 becomes larger, the potential difference between the input voltage $V_{in}$ and the optimum voltage $V_{a1}$ of the curve 1601 also becomes larger. Therefore, in the case where a general liquid crystal display apparatus is used under the condition of the curve 1601, a power loss of the variable voltage regulator 1701 becomes large. This makes it difficult to minimize the power consumption.

SUMMARY OF THE INVENTION

A method for driving a liquid crystal display apparatus according to the present invention including pixels, scanning lines, and data lines, includes the steps of: generating a data signal voltage to be applied to the data lines from a supply voltage; and correcting the supply voltage based on a temperature of the liquid crystal display apparatus.

In one embodiment of the present invention, the step of correcting the supply voltage includes: measuring a temperature of the liquid crystal display apparatus; and correcting the supply voltage so that the data signal voltage becomes lower than a reference voltage in a case where the temperature is higher than a first reference temperature.

In another embodiment of the present invention, the step of correcting the supply voltage includes: measuring a temperature of the liquid crystal display apparatus; and correcting the supply voltage so that the data signal voltage becomes higher than a reference voltage in a case where the temperature is lower than a second reference temperature.

In another embodiment of the present invention, the step of correcting the supply voltage further includes: measuring a temperature of the liquid crystal display apparatus; and correcting the supply voltage to be a first voltage in a case where the temperature is higher than a first reference temperature and correcting the supply voltage to be a second voltage in a case where the temperature is lower than a second reference temperature, wherein the first voltage is lower than the second voltage, and the first reference temperature is higher than the second reference temperature.

A method for driving a liquid crystal display apparatus according to the present invention including pixels, scanning lines, and data lines, includes the steps of: generating a data signal voltage to be applied to the data lines from a power-supply voltage; and correcting the data signal voltage based on a temperature of the liquid crystal display apparatus.

In one embodiment of the present invention, the step of correcting the data signal voltage includes: measuring a temperature of the liquid crystal display apparatus; and correcting the data signal voltage to be lower than a reference voltage in a case where the temperature is higher than a first reference temperature.

In another embodiment of the present invention, the step of correcting the data signal voltage includes: measuring a temperature of the liquid crystal display apparatus; and correcting the data signal voltage to be higher than a reference voltage in a case where the temperature is lower than a second reference temperature.

In another embodiment of the present invention, the step of correcting the data signal voltage further includes: measuring a temperature of the liquid crystal display apparatus; and correcting the data signal voltage to be a first voltage in a case where the temperature is higher than a first reference temperature and correcting the data signal voltage to be a second voltage in a case where the temperature is lower than a second reference temperature, wherein the first voltage is lower than the second voltage, and the first reference temperature is higher than the second reference temperature.

A display apparatus according to the present invention includes: a display panel including a plurality of scanning lines and a plurality of signal lines; a scanning line driver for applying a voltage enabling write signal to the scanning lines in a line sequence; a signal line driver for applying a voltage to the signal lines; a pre-voltage generating device for generating a supply voltage from an input voltage based on a temperature of the display apparatus; and a main voltage generating device for generating a data signal voltage from the supply voltage and outputting the data signal voltage to the signal line driver.

In one embodiment of the present invention, the pre-voltage generating device increases the supply voltage with a decrease in the temperature of the display apparatus and decreases the supply voltage with an increase in the temperature of the display apparatus.

In another embodiment of the present invention, the pre-voltage generating device has a temperature detection circuit for measuring the temperature of the display apparatus.

A display apparatus according to the present invention includes: a display panel including a plurality of scanning lines and a plurality of signal lines; a scanning line driver for applying a voltage enabling write to the scanning lines in line sequence; a signal line driver for applying a voltage to the signal lines; a pre-voltage generating device for generating a supply voltage from a voltage input from outside; and a main voltage generating device for generating a data signal voltage from the supply voltage based on a temperature of the display apparatus and outputting the data signal voltage to the signal line driver.

In one embodiment of the present invention, the main voltage generating apparatus increases the data signal voltage with a decrease in the temperature of the display apparatus and decreases the data signal voltage with an increase in the temperature of the display apparatus.

In another embodiment of the present invention, the main voltage generating device includes a temperature detection circuit for measuring the temperature of the display apparatus.

In another embodiment of the present invention, the main voltage generating device includes a non-selection voltage generating circuit, the non-selection voltage generating circuit has a temperature detection circuit for measuring the temperature of the display apparatus, and the non-selection voltage generating circuit generates a non-selection voltage from the supply voltage as the data signal voltage based on the temperature of the display apparatus.

In another embodiment of the present invention, the non-selection voltage generating circuit increases the non-selection voltage with a decrease in the temperature of the display apparatus and decreases the non-selection voltage with an increase in the temperature of the display apparatus.

In another embodiment of the present invention, the display panel is a simple matrix type display panel.

In another embodiment of the present invention, the display panel is a simple matrix type display panel.

In another embodiment of the present invention, the display panel is an active matrix type display panel.

In another embodiment of the present invention, the display panel is an active matrix type display panel.

Thus, the invention described herein makes possible the advantage of providing a display apparatus in which a variable range of a power-supply voltage can be made narrow, and power consumption can be minimized.

This and other advantages of the present invention will become apparent to those skilled in the art upon reading and understanding the following detailed description with reference to the accompanying figures.

DESCRIPTION OF THE PREFERRED EMBODIMENTS

Figure 1:
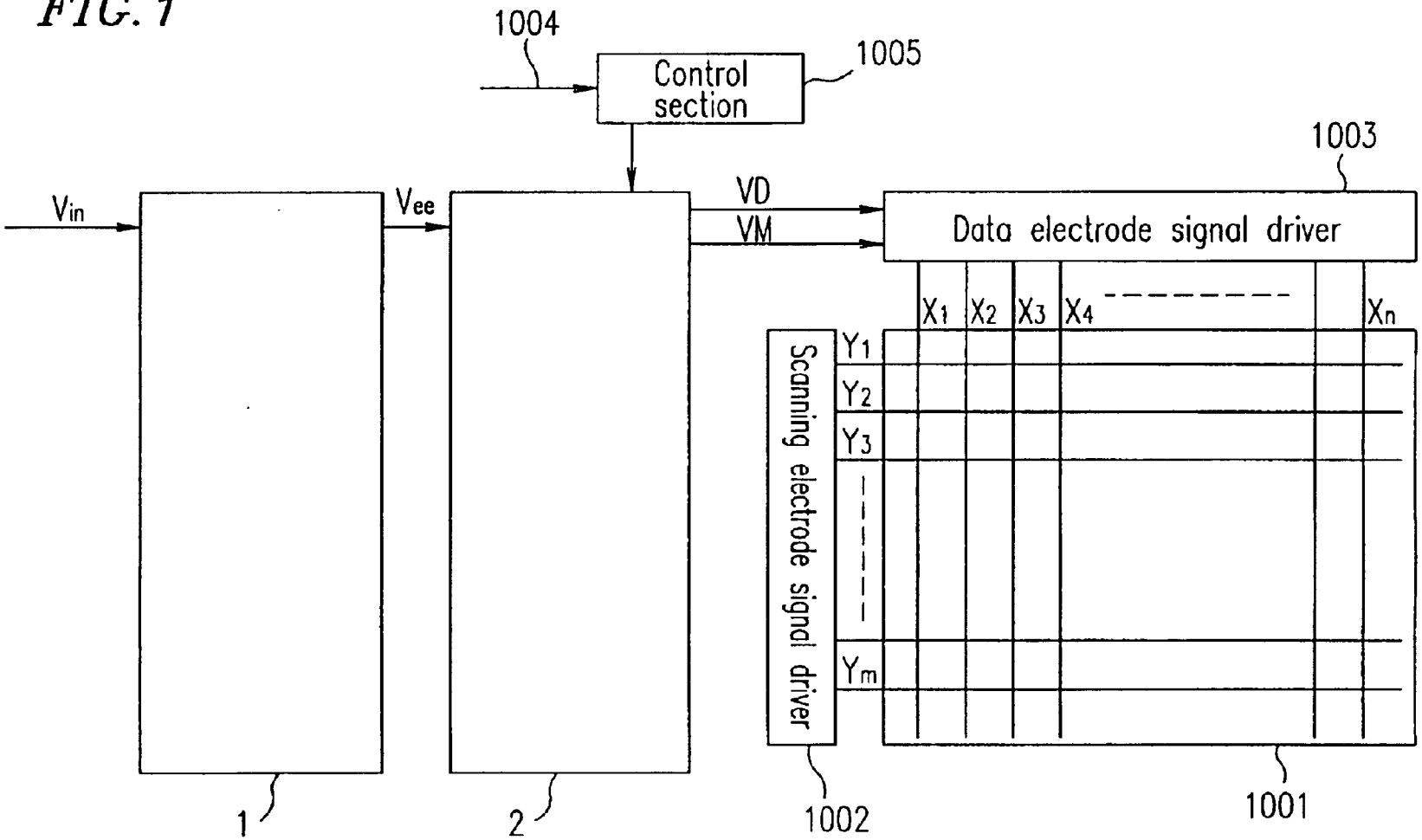
FIG. 1 shows a liquid crystal display apparatus using a pre-voltage generating device in the first example according to the present invention.

Hereinafter, the present invention will be described by way of illustrative examples with reference to the drawings. Like reference numerals refer to like parts throughout the drawings.

EXAMPLE 1

FIG. 1 is a diagram showing a liquid crystal display apparatus using a pre-voltage generating device in the first example according to the present invention.

The liquid crystal display device shown in FIG. 1 includes a plurality of scanning lines $Y_1$ to $Y_m$, a plurality of data lines $X_1$ to $X_n$, a display panel 1001 having a plurality of pixels, a scanning electrode signal driver 1002, a data electrode signal driver 1003, a control section 1005, a pre-voltage generating device 1, and a main voltage generating device 2.

The scanning electrode signal driver 1002 applies a predetermined voltage to the scanning lines $Y_1$ to $Y_m$ of the display panel 1001 in a line sequence. The data electrode signal driver 1003 applies a predetermined voltage (for example, corresponding to on or off state of a pixel) to the data lines $X_1$ to $X_n$ of the display panel 1001 in accordance with display information. The control section 1005 outputs a scanning commencement signal S, a latch pulse LP, an alternating signal M, and various voltages (i.e., write voltages VH and VL, a non-selection voltage VM, and a reference voltage VS).

The pre-voltage generating device 1 receives an input voltage $V_{in}$ and outputs a supply voltage $V_{ee}$ which is corrected (or varied) based on the temperature. More specifically, the pre-voltage generating device 1 corrects the supply voltage $V_{ee}$, based on the temperature of the liquid crystal display apparatus. A temperature $T_a$ of the liquid crystal display device refers to an ambient temperature of the liquid crystal display apparatus. The ambient temperature of the liquid crystal display apparatus is preferably a surface temperature of the display panel 1001. However, the ambient temperature of the liquid crystal display apparatus may also be taken to be the temperature of the pre-voltage generating device 1, the temperature of the main voltage generating device 2 or the temperature of an element included in the liquid crystal display apparatus. The main voltage generating device 2 receives the corrected supply voltage $V_{ee}$, and generates a data signal voltage VD in accordance with the corrected supply voltage $V_{ee}$. The data electrode signal driver 1003 receives the data signal voltage VD, and applies the data signal voltage VD to a data line.

Hereinafter, an exemplary operation of the pre-voltage generating device 1 will be described with reference to FIG. 2.

The pre-voltage generating device 1 measures the temperature $T_a$ of the liquid crystal display device (Step S1). The pre-voltage generating device 1 compares the temperature $T_a$ of the liquid crystal display device with a first reference temperature (Step S2). In the case where the temperature $T_a$ of the liquid crystal display device is lower than the first reference temperature (YES), the pre-voltage generating device 1 corrects the supply voltage $V_{ee}$ so that the data signal voltage VD becomes higher than a reference voltage (Step S3). In the case where the temperature $T_a$ of the liquid crystal display apparatus is not lower than the first reference temperature (NO), the process proceeds to Step S4. The pre-voltage generating device 1 then compares the temperature $T_a$ of the liquid crystal display apparatus with a second reference temperature (Step S4). In the case where the temperature $T_a$ of the liquid crystal display apparatus is higher than the second reference temperature (YES), the pre-voltage generating device 1 corrects the supply voltage $V_{ee}$ so that the data signal voltage VD becomes lower than the reference voltage (Step S5). In FIG. 2 the first reference temperature is higher than the second reference temperature, wherein the first reference temperature is, for example, 50° C., and the second reference temperature is, for example, 0° C.

Because of the operation of the pre-voltage generating device 1, the liquid crystal display device using the pre-voltage generating device 1 in the first example according to the present invention has the following characteristics.

Figure 3:
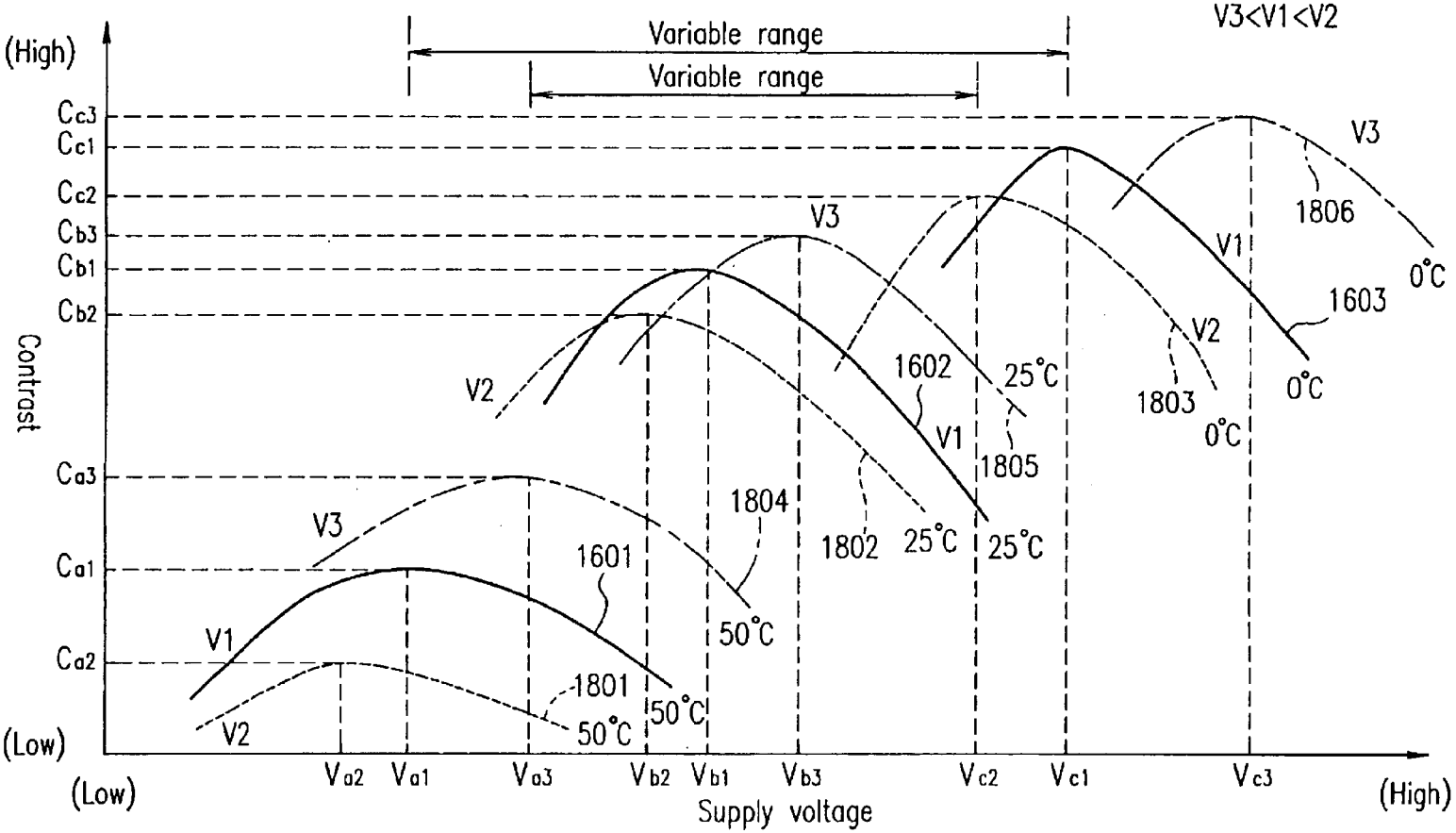
FIG. 3 is a graph showing the relationship between the contrast, the supply voltage $V_{ee}$, the data signal voltage VD, and a temperature $T_a$ of the liquid crystal display apparatus.

FIG. 3 is a graph showing the relationship between the contrast, the supply voltage $V_{ee}$, the data signal voltage VD, and the temperature $T_a$ of the liquid crystal display device.

A curve 1601 represents a contrast-supply voltage characteristic at VD=V1 and $T_a$=50° C., with the contrast becoming maximum at a supply voltage $V_{a1}$. A curve 1602 represents a contrast-supply voltage characteristic at VD=V1 and $T_a$=25° C., with the contrast becoming maximum at a supply voltage $V_{b1}$. The curve 1603 represents a contrast-supply voltage characteristic at VD=V1 and $T_a$=0° C., with the contrast becoming maximum at a supply voltage $V_{c1}$.

A curve 1801 represents a contrast-supply voltage characteristic at VD=V2 and $T_a$=50° C., with the contrast becoming maximum at a supply voltage $V_{a2}$. A curve 1802 represents a contrast-supply voltage characteristic at VD=V2 and $T_a$=25° C., with the contrast becoming maximum at a supply voltage $V_{b2}$. A curve 1803 represents a contrast-supply voltage characteristic at VD=V2 and $T_a$=0° C., with the contrast becoming maximum at a supply voltage $V_{c2}$.

A curve 1804 represents a contrast-supply voltage characteristic at VD=V3 and $T_a$=50° C., with the contrast becoming maximum at a supply voltage $V_{a3}$. A curve 1805 represents a contrast-supply voltage characteristic at VD=V3 and $T_a$=25° C., with the contrast becoming maximum at a supply voltage $V_{b3}$. A curve 1806 represents a contrast-supply voltage characteristic at VD=V3 and $T_a$=0° C., with the contrast becoming maximum at a supply voltage $V_{c3}$. The data signal voltages have the relationship: V2>V1>V3.

The contrast is higher in the case where the temperature $T_a$ is 0° C. and the data signal voltage is in a range of V2 to V3 than in the case where the temperature $T_a$ is 25° C. which is a standard use temperature and the data signal voltage is in a range of V2 to V3. More specifically, when the temperature $T_a$ is 0° C., even though the data signal voltage is V2, a sufficient contrast can be obtained.

In the case where the temperature $T_a$ is 50° C., a contrast at the data signal voltage V3 becomes higher than that at the other data signal voltages.

When the temperature $T_a$ is 0° C., the pre-voltage generating device 1 can correct the supply voltage $V_{ee}$ thereof to be $V_{c2}$. When the temperature $T_a$ is 50° C., the pre-voltage generating device 1 can correct the supply voltage $V_{ee}$ to be $V_{a3}$. Consequently, the liquid crystal display apparatus having the pre-voltage generating device 1 can decrease the variation width of a supply voltage to be supplied to the main voltage generating device 2, compared with the liquid crystal display apparatus without having the pre-voltage generating device 1. This allows the power consumption of the liquid crystal display apparatus having the pre-voltage generating device 1 to be reduced, which results in a decrease in the withstanding voltage of components of the liquid crystal display apparatus having the pre-voltage generating device 1.

Figure 2:
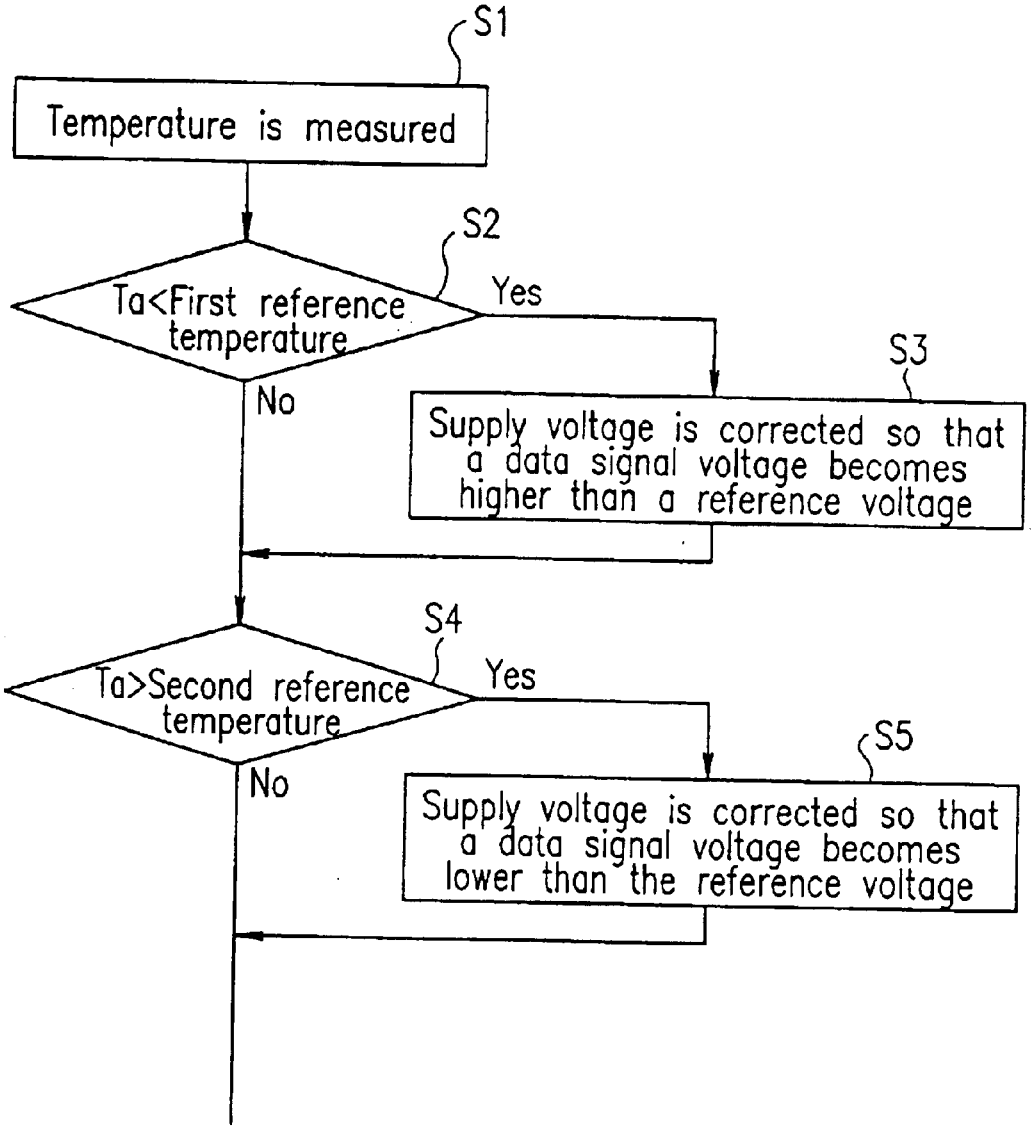
FIG. 2 shows an operation of the pre-voltage generating device in the first example according to the present invention.

It is noted that operations other than that shown in FIG. 2 can be used for obtaining the above-mentioned effects. For example, Steps S2 and S3 may be omitted in the operation shown in FIG. 2. Alternatively, Steps S4 and S5 may be omitted in the operation shown in FIG. 2. These are other variation and modifications are contemplated as falling within the scope of the present invention.

Figure 4:
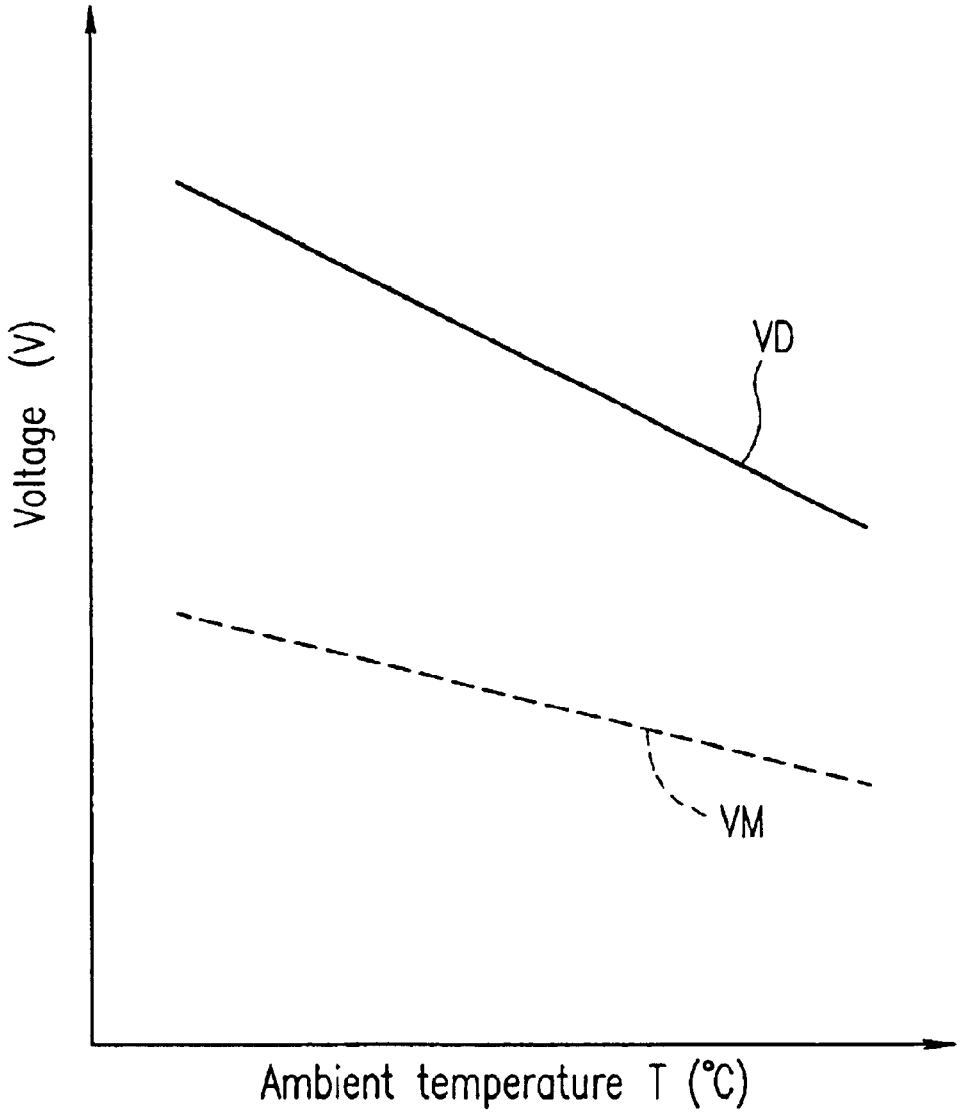
FIG. 4 is a graph showing that the data signal voltage VD and the non-selection voltage VM are linearly varied depending upon the temperature of the liquid crystal display apparatus.
Figure 5:
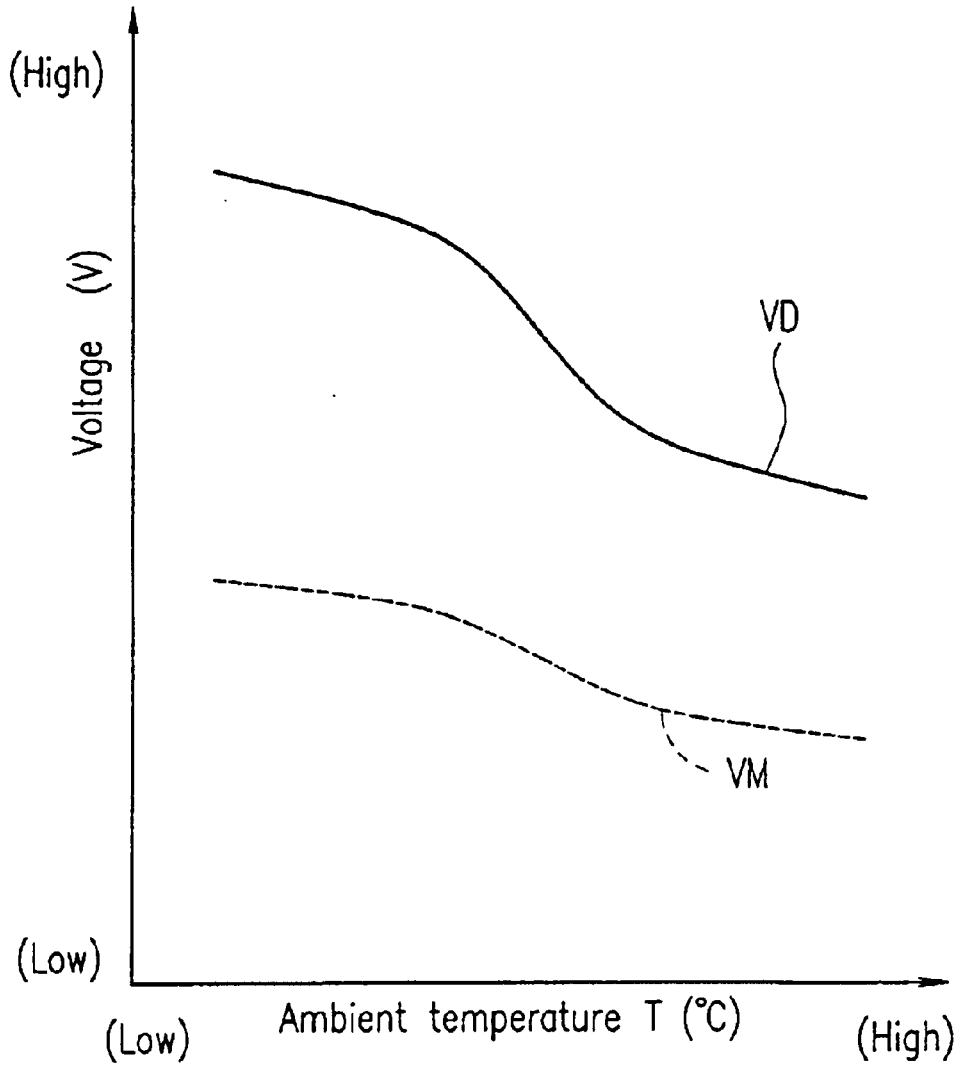
FIG. 5 is a graph showing that the data signal voltage VD and the non-selection voltage VM are non-linearly varied depending upon the temperature of the liquid crystal display apparatus.

In the present example, the supply voltage $V_{ee}$ is varied depending upon the temperature $T_a$ of the liquid crystal display apparatus so as to vary the data signal voltage VD. However, the supply voltage $V_{ee}$ may be varied in such a manner that the data signal voltage VD and the non-selection voltage VM are varied as shown in FIGS. 4 and 5. In particular, FIG. 5 shows changes in the data signal voltage VD and the non-selection voltage VM with respect to the temperature $T_a$ of the liquid crystal display apparatus in the case where a contrast becomes saturated to some degree at a low temperature and a high temperature. Alternatively, FIG. 5 shows changes in the data signal voltage VD and the non-selection voltage VM with respect to the temperature $T_a$ of the liquid crystal display device in the case where the data signal voltage VD and the non-selection voltage VM are varied in a range of a voltage of the main voltage generating device 2. Straight lines and curves in FIGS. 4 and 5 are obtained from the contrast-supply voltage characteristics as shown in FIG. 3. A contrast-supply voltage characteristic is varied depending upon each kind of a liquid crystal display apparatus.

Hereinafter, exemplary circuit configurations of the pre-voltage generating device 1 and the main voltage generating device 2 will be described.

Figure 6:
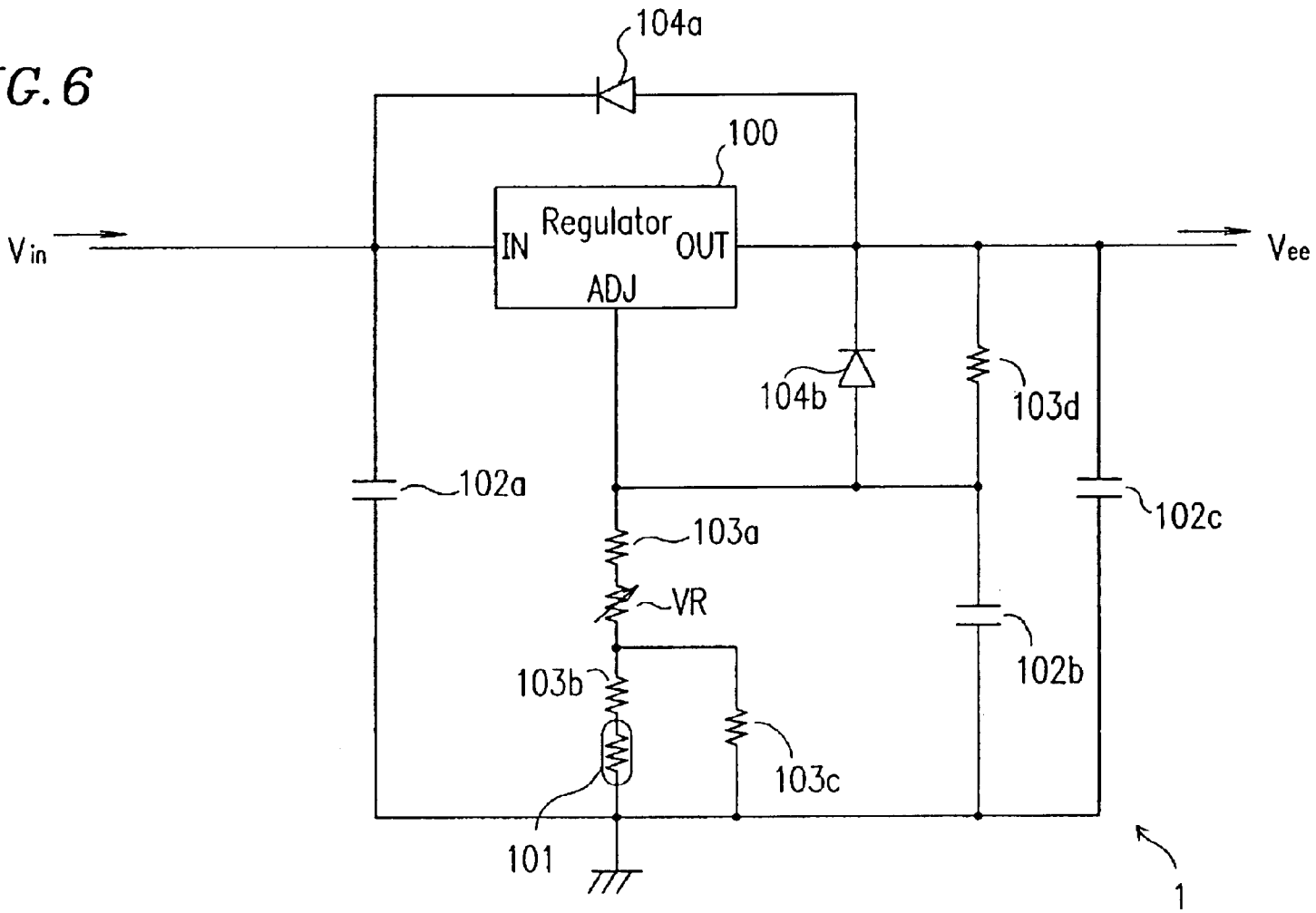
FIG. 6 shows an exemplary circuit configuration of the pre-voltage generating device in the first example according to the present invention.

FIG. 6 shows an exemplary circuit configuration of the pre-voltage generating device 1.

The pre-voltage generating device 1 shown in FIG. 6 includes a regulator 100, a thermistor 101, a variable resistor VR, capacitors 102*a,* 102*b,* and 102*c,* resistors 103*a,* 103*b,* 103*c,* and 103*d,* and diodes 104*a* and 104*b*.

Figure 8:
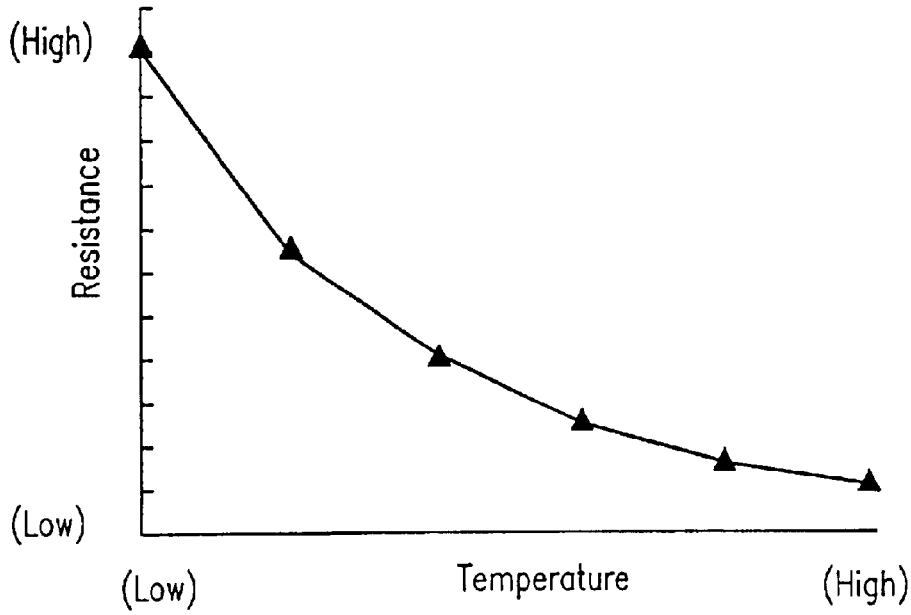
FIG. 8 is a graph showing a temperature-resistance characteristic of a thermistor used in the pre-voltage generating device in the first example according to the present invention.

The pre-voltage generating device 1 shown in FIG. 6 uses the regulator 100. The pre-voltage generating device 1 shown in FIG. 6 receives an input voltage $V_{in}$. The resistances of the thermistor 101 and the variable resistor VR coupled to the regulator 100 are varied, whereby a supply voltage $V_{ee}$ is generated from the input voltage $V_{in}$. The variable resistor VR is used for fine-adjusting the supply voltage $V_{ee}$. FIG. 8 shows a temperature-resistance characteristic of the thermistor 101. The thermistor is a device whose resistance decreases with an increase in temperature. The temperature-resistance characteristic of the thermistor described hereinafter is substantially identical with that shown in FIG. 8.

Figure 7:
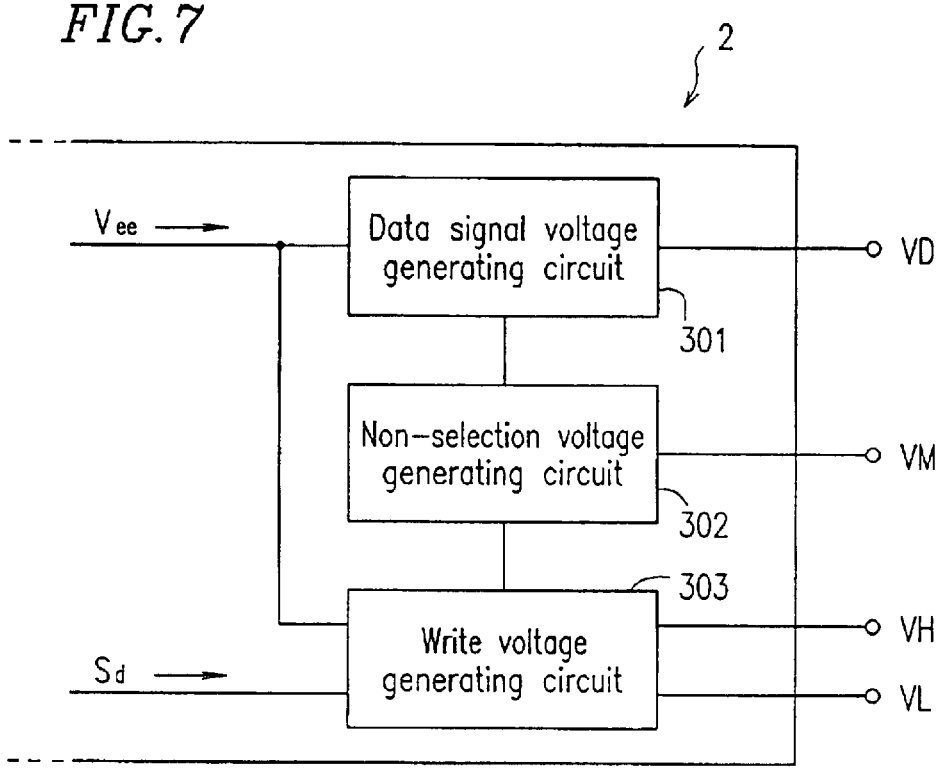
FIG. 7 shows an exemplary configuration of a main voltage generating device in the first example according to the present invention.

FIG. 7 shows an exemplary configuration of the main voltage generating device 2. The main voltage generating device 2 shown in FIG. 7 includes a data signal voltage generating circuit 301, a non-selection voltage generating circuit 302, and a write voltage generating circuit 303. The supply voltage $V_{ee}$ is input to the data signal voltage generating circuit 301 and the write voltage generating circuit 303. The data signal voltage generating circuit 301 generates the data signal voltage VD from the input supply voltage $V_{ee}$ and outputs it. Furthermore, the data signal voltage VD is input to the non-selection voltage generating circuit 302, and the non-selection voltage generating circuit 302 generates the non-selection voltage VM. The write voltage generating circuit 303 generates write voltages VH and VL from the supply voltage $V_{ee}$, the non-selection voltage VM, and a control signal $S_d$.

Figure 9:
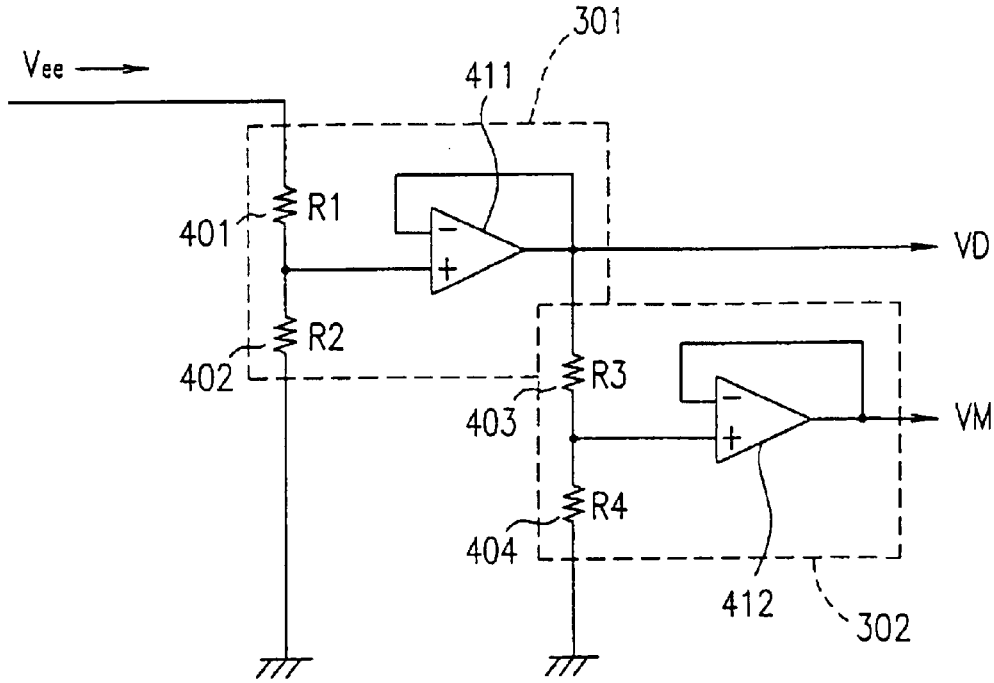
FIG. 9 shows an exemplary circuit configuration of the main voltage generating device shown in FIG. 7.

FIG. 9 shows an exemplary circuit configuration of the main voltage generating device 2 shown in FIG. 7.

The circuit shown in FIG. 9 includes resistors 401 to 404, and operational amplifiers 411 and 412. The data signal voltage VD is determined based on the input supply voltage $V_{ee}$ and the resistance ratio between the resistors 401 and 402.

Assuming that the resistances of the resistors 401 and 402 are R1 and R2, respectively, the data signal voltage VD is represented by the following Expression (3):

$$VD=V_{ee}\times R2/(R1+R2) \tag{3}$$

A data signal voltage generating circuit 301 shown in FIG. 9 generates the data signal voltage VD at a predetermined ratio with respect to the supply voltage $V_{ee}$ which is corrected based on the changes in the temperature $T_a$ of the liquid crystal display apparatus.

A non-selection voltage generating circuit 302 shown in FIG. 9 includes the resistors 403 and 404 and the operational amplifier 412.

The non-selection voltage generating circuit 302 shown in FIG. 9 generates, based on the data signal voltage VD, the non-selection voltage signal VM satisfying the following Expression (4):

$$VM=VD/2 \tag{4}$$

In the case of the exemplary circuit shown in FIG. 9, assuming that the resistances of the resistors 403 and 404 are R3 and R4, respectively, the resistances R3 and R4 satisfy the following Expression (5):

$$R3=R4 \tag{5}$$

Figure 10:
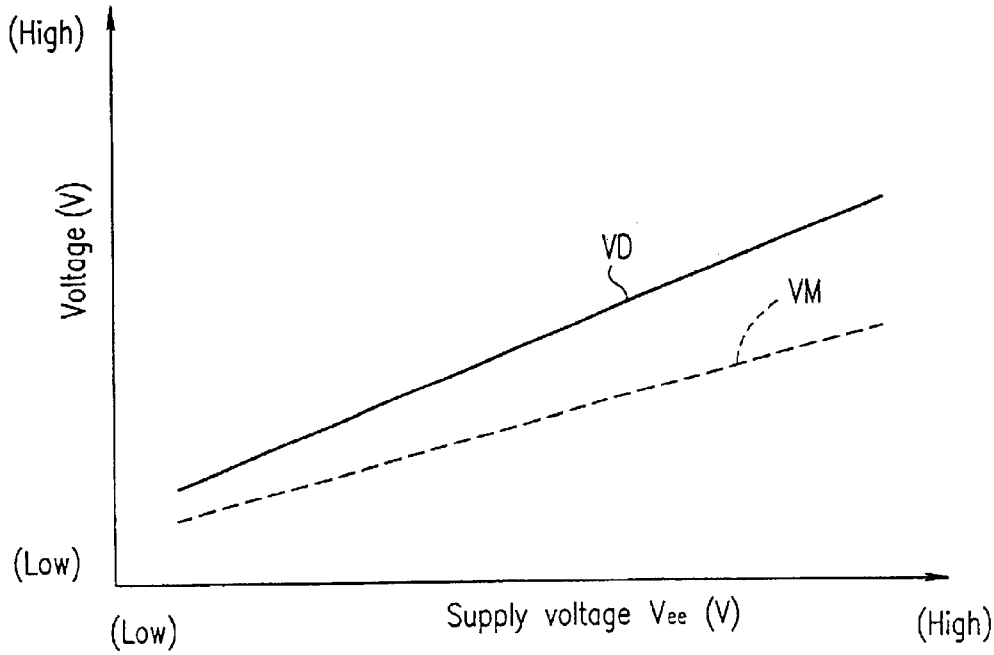
FIG. 10 is a graph showing the relationship between the supply voltage $V_{ee}$ which the circuit shown in FIG. 9 receives, and the data signal voltage VD and the non-selection voltage VM generated by the circuit shown in FIG. 9.

FIG. 10 is a graph showing the relationship between the supply voltage $V_{ee}$ which the circuit shown in FIG. 9 receives, and the data signal voltage VD and the non-selection voltage VM generated by the circuit shown in FIG. 9.

Figure 11:
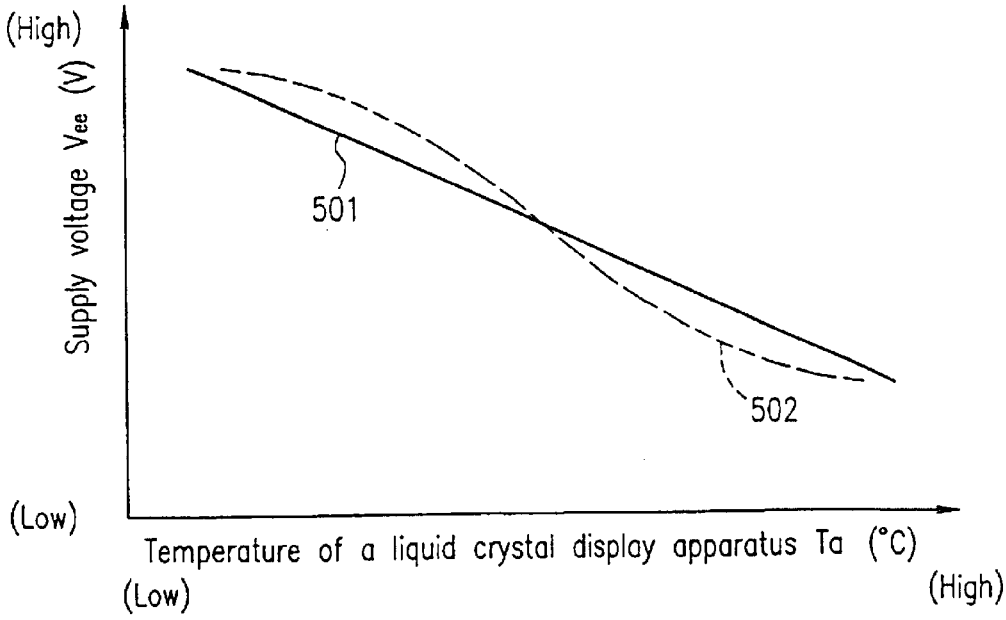
FIG. 11 is a graph showing the relationship between the supply voltage generated by the pre-voltage generating device shown in FIG. 6 and the temperature $T_a$ of the liquid crystal display apparatus.

FIG. 11 is a graph showing the relationship between the supply voltage generated by the pre-voltage generating device shown in FIG. 6 and the temperature $T_a$ of the liquid crystal display apparatus.

A straight line 501 shows the case where the supply voltage $V_{ee}$ of the liquid crystal display apparatus is linearly varied with the changes in the temperature $T_a$ of the liquid crystal display apparatus. A curve 502 shows the case where a contrast becomes saturated at a high temperature and a low temperature, or an adjustment range of the supply voltage $V_{ee}$ is limited.

In the present example, the supply voltage $V_{ee}$ to be input is corrected based on the temperature $T_a$ of the liquid crystal display apparatus, and the data signal voltage VD and the non-selection voltage VM are corrected in accordance with the corrected supply voltage $V_{ee}$.

Figure 12:
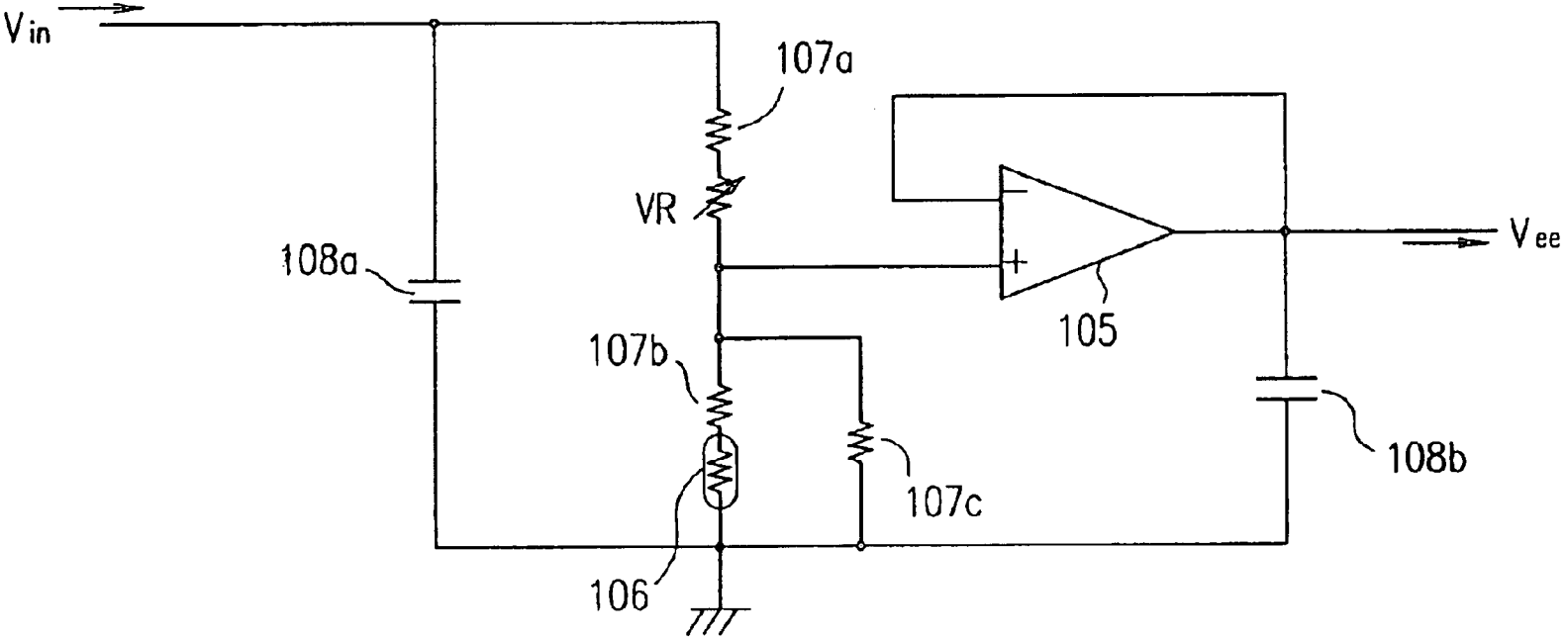
FIG. 12 shows another exemplary circuit configuration of the pre-voltage generating device in the first example according to the present invention.

As the pre-voltage generating device in the first example, the circuit shown in FIG. 12 may be used in place of that shown in FIG. 6.

The pre-voltage generating device shown in FIG. 12 includes an upper resistor including a variable resistor VR and a resistor 107*a* and a lower resistor including a thermistor 106 and a resistor 107*b,* a resistor 107*c,* and capacitors 108*a* and 108*b*.

The input voltage $V_{in}$ is divided in accordance with the resistance ratio between the upper resistor and the lower resistor. The voltage thus obtained is smoothed by the operational amplifier 105. Thus, the resistance of the thermistor 106 is varied depending upon the temperature $T_a$ of the liquid crystal display apparatus. Therefore, the non-selection voltage $V_{ee}$ is varied depending upon the temperature $T_a$ of the liquid crystal display apparatus. The pre-voltage generating device shown in FIG. 12 can decrease the variation width of a supply voltage to be supplied to the main voltage generating device 2.

EXAMPLE 2

Figure 13:
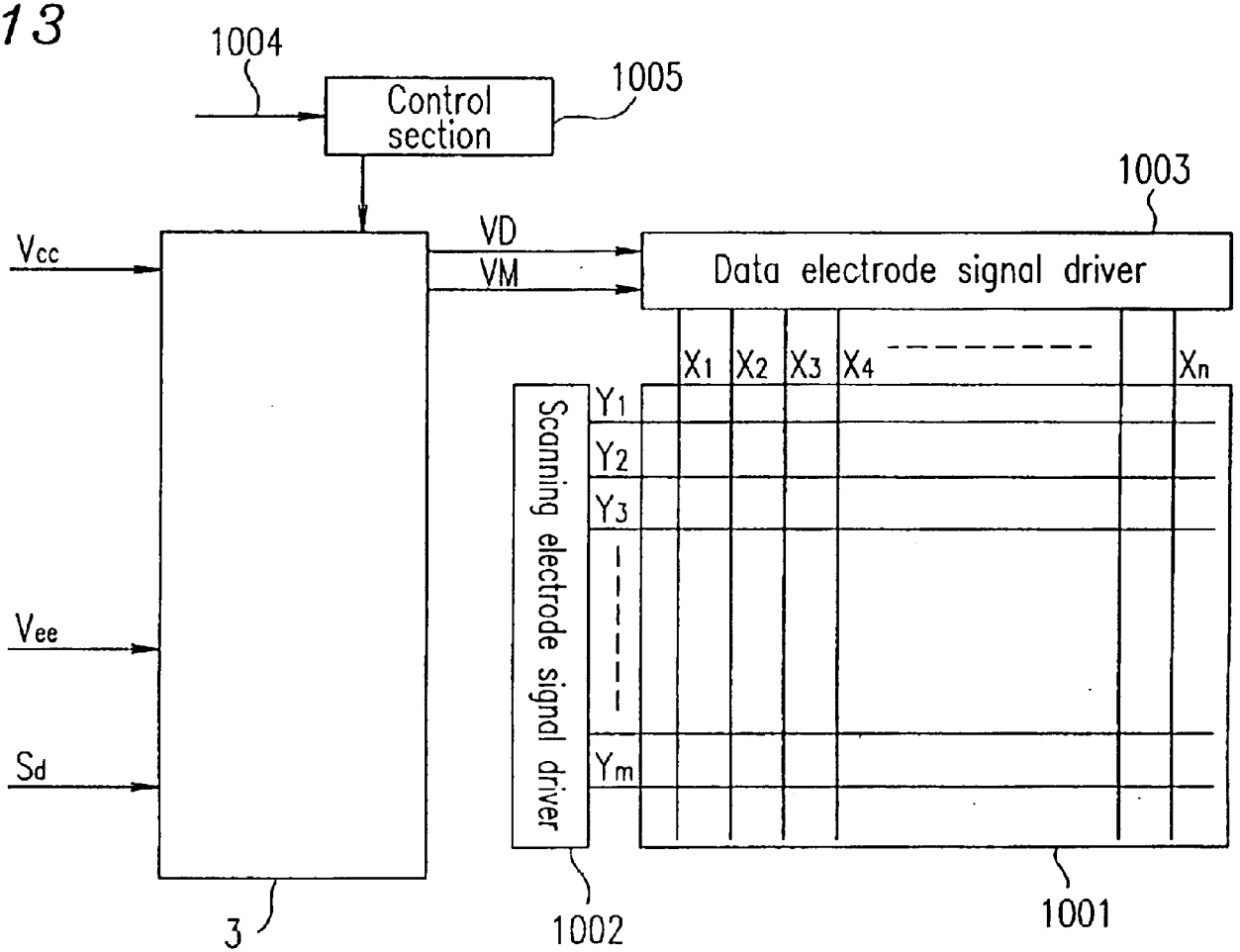
FIG. 13 shows a liquid crystal display apparatus using a main voltage generating device in the second example according to the present invention.

FIG. 13 shows a liquid crystal display apparatus using a main generating device in the second example according to the present invention.

The liquid crystal display apparatus shown in FIG. 13 includes a plurality of scanning lines $Y_1$ to $Y_m$, a plurality of data lines $X_1$ to $X_n$, a display panel 1001 having a plurality of pixels, a scanning electrode signal driver 1002, a data electrode signal driver 1003, a control section 1005, and a main voltage generating device 3.

The scanning electrode signal driver 1002 applies a predetermined voltage to the scanning lines $Y_1$ to $Y_m$ of the display panel 1001 in a line sequence. The data electrode signal driver 1003 applies a predetermined voltage (for example, corresponding to on or off state of a pixel) to the data lines $X_1$ to $X_n$ of the display panel 1001 in accordance with display information. The control section 1005 outputs a scanning commencement signal S, a latch pulse LP, an alternating signal M, and various voltages (i.e., write voltages VH and VL, a non-selection voltage VM, and a reference voltage VS).

The main voltage generating device 3 receives a logic circuit power-supply voltage $V_{cc}$, and outputs a data signal voltage VD and a non-selection voltage VM which are corrected based on the temperature. More specifically, the main voltage generating device 3 corrects the data signal voltage VD and the non-selection voltage VM, based on the temperature of the liquid crystal display apparatus.

Hereinafter, an exemplary operation of the main voltage generating device 3 will be described with reference to FIG. 14.

The main voltage generating device 3 measures a temperature $T_a$ of the liquid crystal display apparatus (Step S11). The main voltage generating device 3 compares the temperature $T_a$ of the liquid crystal display apparatus with a first reference temperature (Step S12). In the case where the temperature $T_a$ of the liquid crystal display apparatus is higher than the first reference temperature (YES), the main voltage generating device 3 corrects the data signal voltage VD to be lower than a reference voltage (Step S13). In the case where the temperature $T_a$ of the liquid crystal display apparatus is not higher than the first reference temperature (NO), the process proceeds to Step S14. The main voltage generating device 3 then compares the temperature $T_a$ of the liquid crystal display apparatus with a second reference temperature (Step S14). In the case where the temperature $T_a$ of the liquid crystal display apparatus is lower than the second reference temperature (YES), the main voltage generating device 3 corrects the data signal voltage to be higher than the reference voltage (Step S15). The first reference temperature is higher than the second reference temperature, wherein the first reference temperature is, for example, 50° C., and the second reference temperature is, for example, 0° C.

Figure 14:
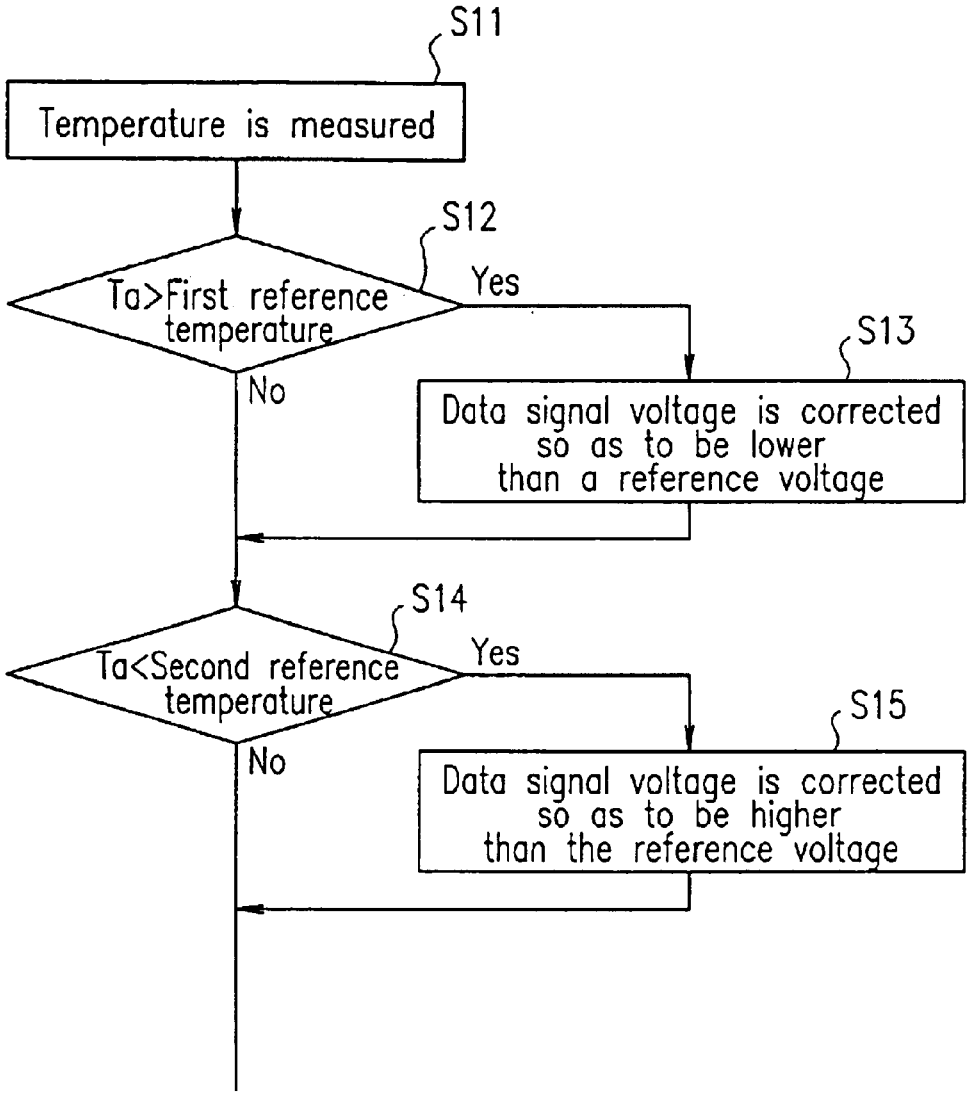
FIG. 14 shows an operation of the main voltage generating device in the second example according to the present invention.

Steps S12 and S13 may be omitted in the operation shown in FIG. 14. Alternatively, Steps S14 or S15 may be omitted in the operation shown in FIG. 14. Each of the above variations as well as other modifications are contemplated as falling within the scope of the present invention.

The non-selection voltage VM may be obtained from the relationship between the data signal voltage VD and the non-selection voltage VM shown in FIG. 4. Although the data signal voltage VD is corrected based on the temperature $T_a$ of the liquid crystal display apparatus in the above-mentioned operation of the main voltage generating device 3, both the data signal voltage VD and the non-selection voltage VM may be corrected based on the temperature $T_a$. It is also possible that the non-selection voltage VM may be corrected based on the temperature $T_a$ of the liquid crystal display apparatus, and the data signal voltage VD be obtained from the relationship between the data signal voltage VD and the non-selection voltage VM shown in FIG. 4.

Figure 15:
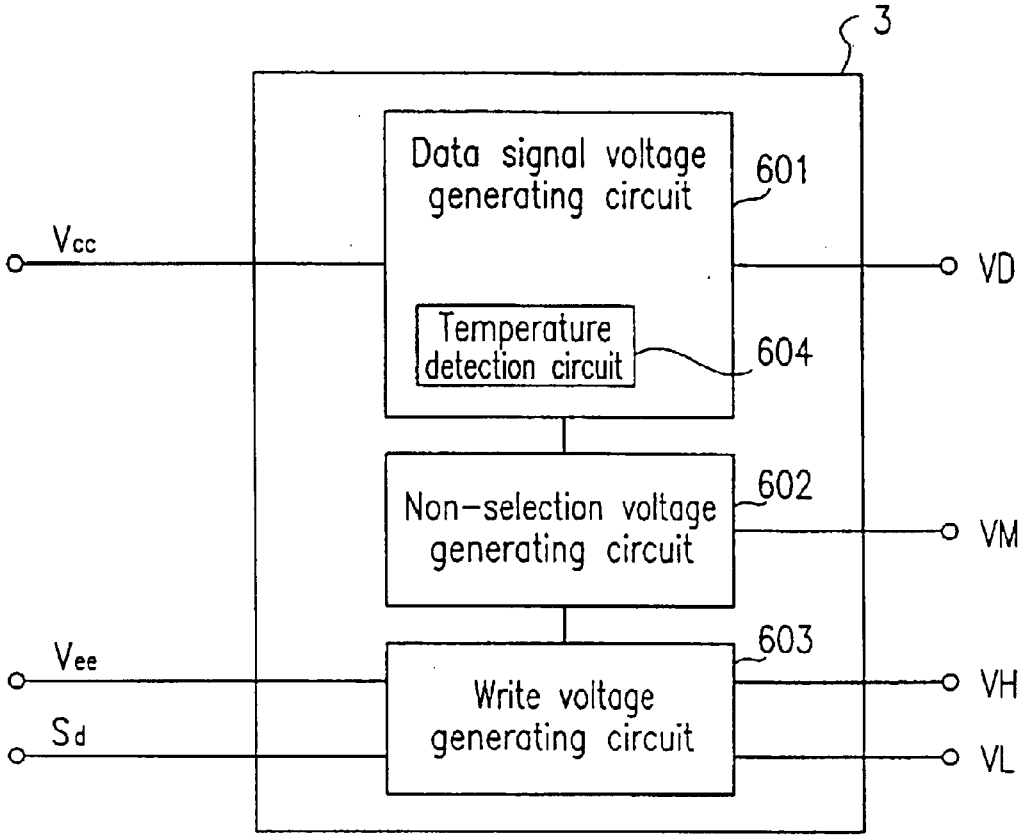
FIG. 15 shows an exemplary configuration of the main voltage generating device in the second example according to the present invention.

FIG. 15 shows an exemplary configuration of the main voltage generating device 3 in the second example according to the present invention. The main voltage generating device 3 generates the data signal voltage VD and the non-selection voltage VM from the logic circuit power-supply voltage $V_{cc}$.

The main voltage generating device 3 includes a data signal voltage generating circuit 601, a non-selection voltage generating circuit 602, and a write voltage generating circuit 603.

The logic circuit power-supply voltage $V_{cc}$ is input to the data signal voltage generating circuit 601. The data signal voltage generating circuit 601 generates the data signal voltage VD from the input logic circuit power-supply voltage $V_{cc}$. The data signal voltage generating circuit 601 has a temperature detection circuit 604 and corrects the data signal voltage VD based on the temperature $T_a$ of the liquid crystal display apparatus.

The data signal voltage VD is input to the non-selection voltage generating circuit 602, and the non-selection voltage generating circuit 602 generates the non-selection voltage VM based on the data signal voltage VD.

The write voltage generating circuit 603 generates write voltages VH and VL from a supply voltage $V_{ee}$, the non-selection voltage VM, and a control signal $S_d$.

Figure 16:
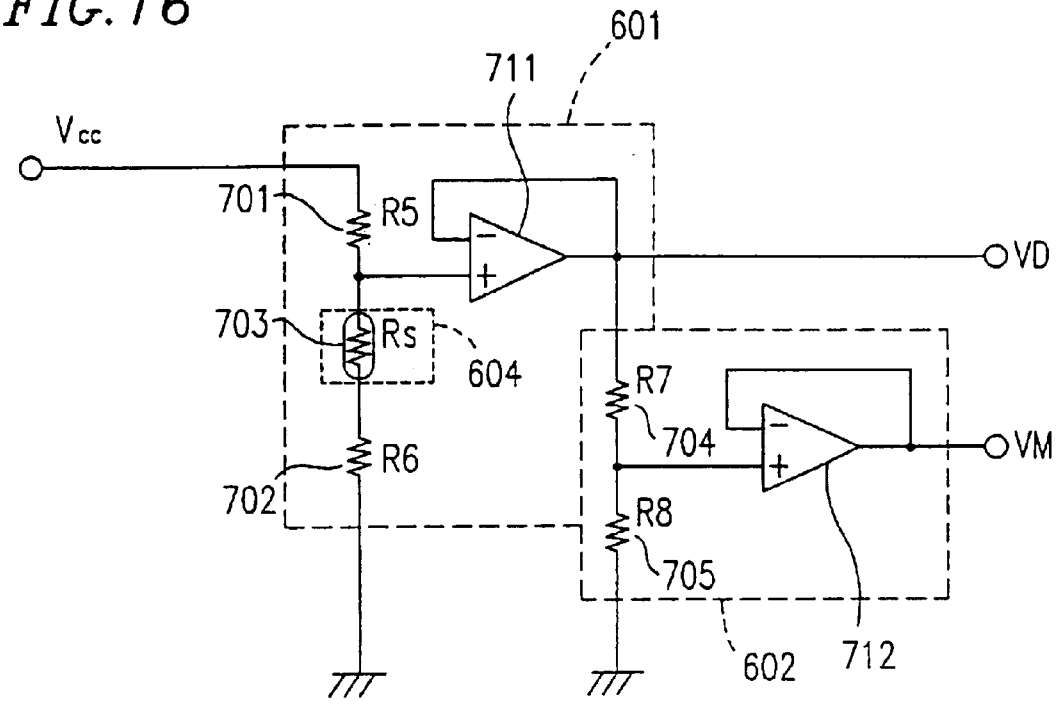
FIG. 16 shows an exemplary circuit configuration of the main voltage generating device shown in FIG. 15.

FIG. 16 shows an exemplary circuit configuration of the main voltage generating device 3 shown in FIG. 15.

The circuit shown in FIG. 16 includes resistors 701, 702, 704, and 705, operational amplifiers 711 and 712, and a thermistor 703 which operates as a temperature detection circuit 604.

It is assumed that the resistances of the resistors 701 and 702 are R5 and R6, respectively, and the resistance of the thermistor 703 is $R_s$. The data signal voltage VD is obtained by dividing the input logic circuit power-supply voltage $V_{cc}$ in accordance with the resistance ratio between the resistance R5, and the resistance R6 and the resistance $R_s$. The data signal voltage VD is represented by the following Expression (6):

$$VD=V_{cc}\times(R_s+R6)/(R5+R_s+R6) \quad (6)$$

In the circuit shown in FIG. 16, the resistance $R_s$ of the thermistor 703 of the data signal voltage generating circuit 601 is varied depending upon the temperature of the liquid crystal display apparatus. Therefore, in the circuit shown in FIG. 16, the data signal voltage VD can be varied depending upon the temperature $T_a$ of the liquid crystal display apparatus.

The non-selection voltage generating circuit 602 shown in FIG. 16 generates, from the data signal voltage VD, the non-selection voltage signal VM satisfying the following Expression (7):

$$VM=VD/2 \quad (7)$$

In the case of this exemplary circuit, the resistances of the resistors 704 and 705 are R7 and R8, respectively, satisfying the following Expression (8):

$$R7=R8 \quad (8)$$

Thus, in the voltage generating device in the present example, the data signal voltage VD and the non-selection voltage VM can be non-linearly varied depending upon the temperature $T_a$ of the liquid crystal display apparatus, as shown in FIG. 5.

Figure 17:
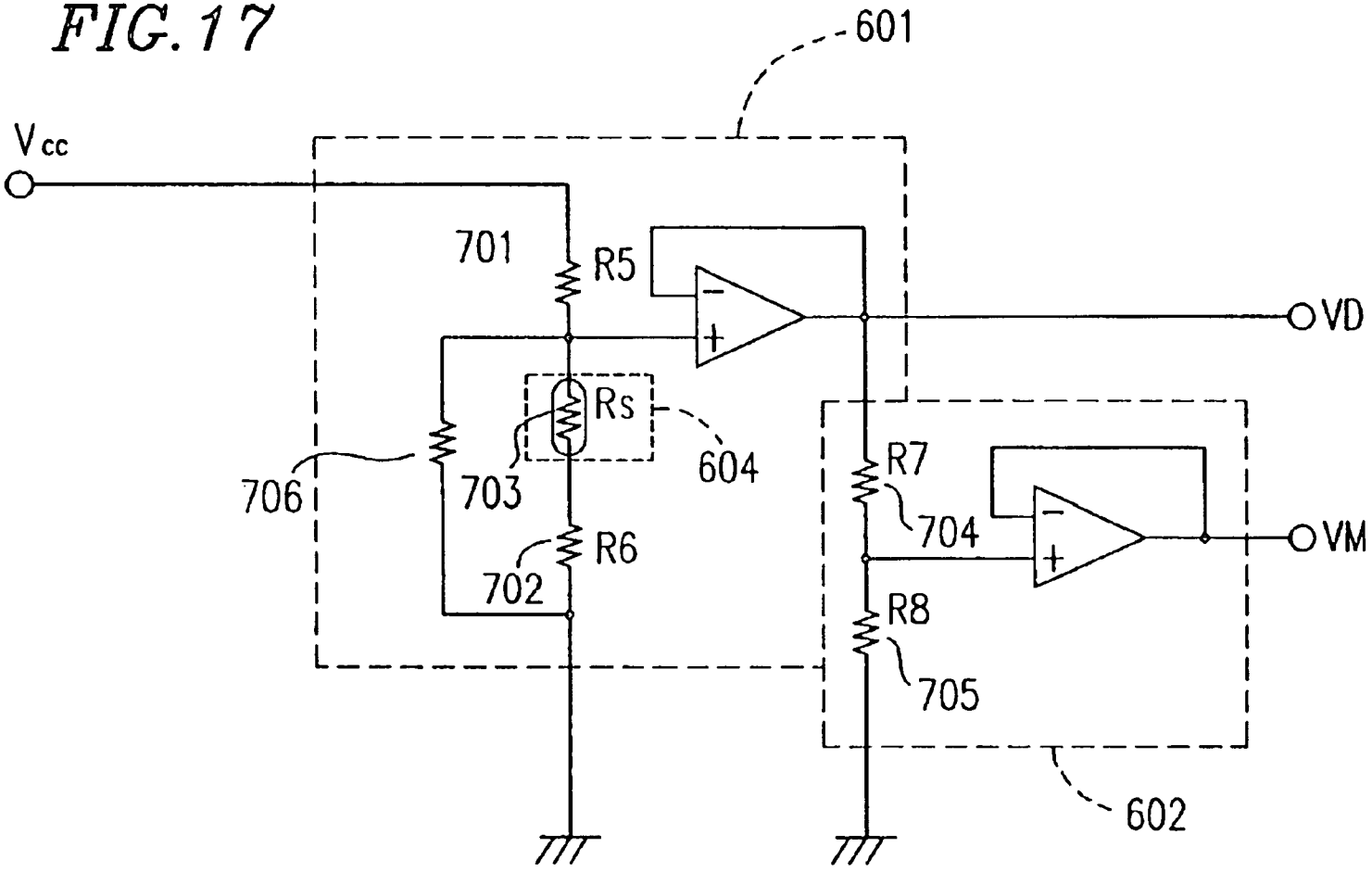
FIG. 17 shows another exemplary circuit configuration of the main voltage generating device shown in FIG. 15.

FIG. 17 is another exemplary circuit configuration of the main voltage generating device 3 shown in FIG. 15. In the circuit shown in FIG. 17, the data signal voltage VD and the non-selection voltage VM are linearly varied depending upon the temperature $T_a$ of the liquid crystal display apparatus.

In the circuit shown in FIG. 17, the thermistor 703 and the resistor 702 are connected in series to each other, and they are connected in parallel to the resistor 706. In the case of the circuit shown in FIG. 17, the data signal voltage VD and the non-selection voltage VM can be linearly varied depending upon the changes in the temperature $T_a$ of the liquid crystal display apparatus, as shown in FIG. 4.

It is determined based on the contrast-temperature of the liquid crystal display apparatus characteristic whether the data signal voltage VD and the non-selection voltage VM are varied as shown in FIG. 4 or the data signal voltage VD and the non-selection voltage VM are varied as shown in FIG. 5.

Figure 18:
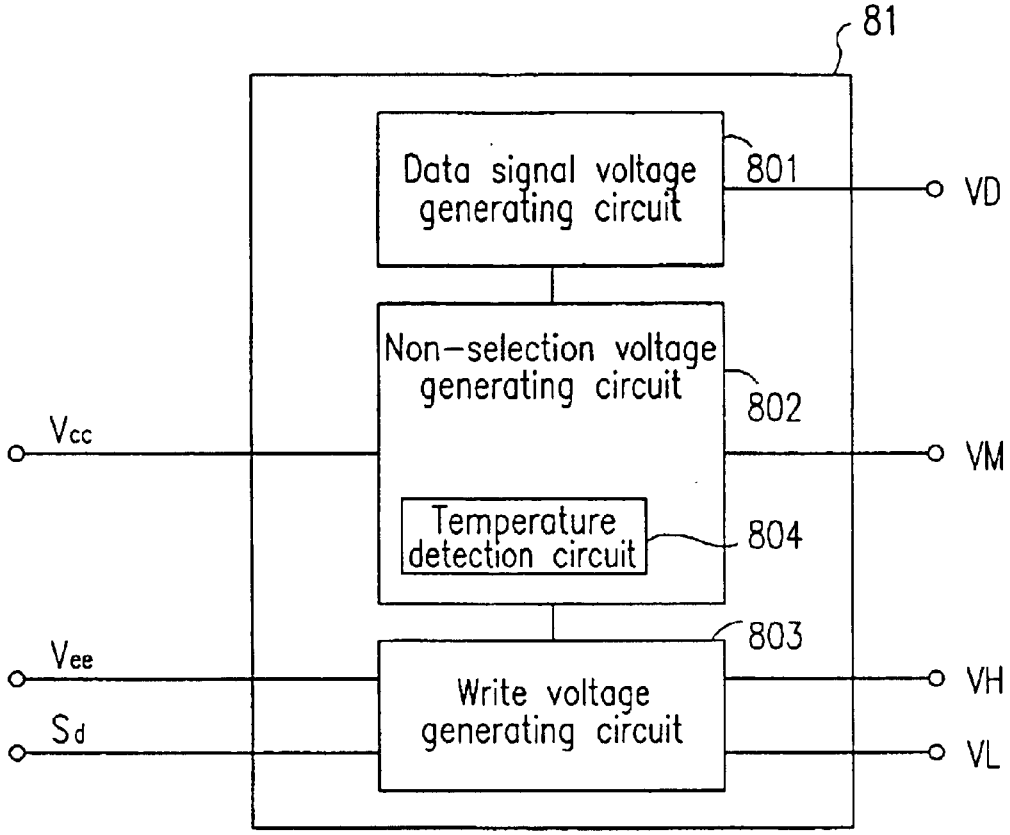
FIG. 18 shows another exemplary configuration of the main voltage generating device in the second example according to the present invention.

FIG. 18 is another exemplary configuration of the main voltage generating circuit 3 in the second example according to the present invention.

The main voltage generating device 81 shown in FIG. 18 generates the data signal voltage VD and the non-selection voltage VM from the logic circuit power-supply voltage $V_{cc}$. The main voltage generating device 81 shown in FIG. 18 includes a data signal voltage generating circuit 801, a non-selection voltage generating circuit 802, and a write voltage generating circuit 803. The logic circuit power-supply voltage $V_{cc}$ is input to the non-selection voltage generating circuit 802. The non-selection voltage generating circuit 802 generates the non-selection voltage VM from the input logic circuit power-supply voltage $V_{cc}$. The non-selection voltage generating circuit 802 has a temperature detection circuit 804, and corrects the non-selection voltage VM based on the temperature $T_a$ of the liquid crystal display apparatus. The non-selection voltage VM is input to the data signal voltage generating circuit 801 and the data signal voltage generating circuit 801 generates the data signal voltage VD based on the non-selection voltage VM. The write voltage generating circuit 803 generates the write voltages VH and VL from the supply voltage $V_{ee}$, the non-selection voltage VM and the control signal $S_d$.

Figure 19:
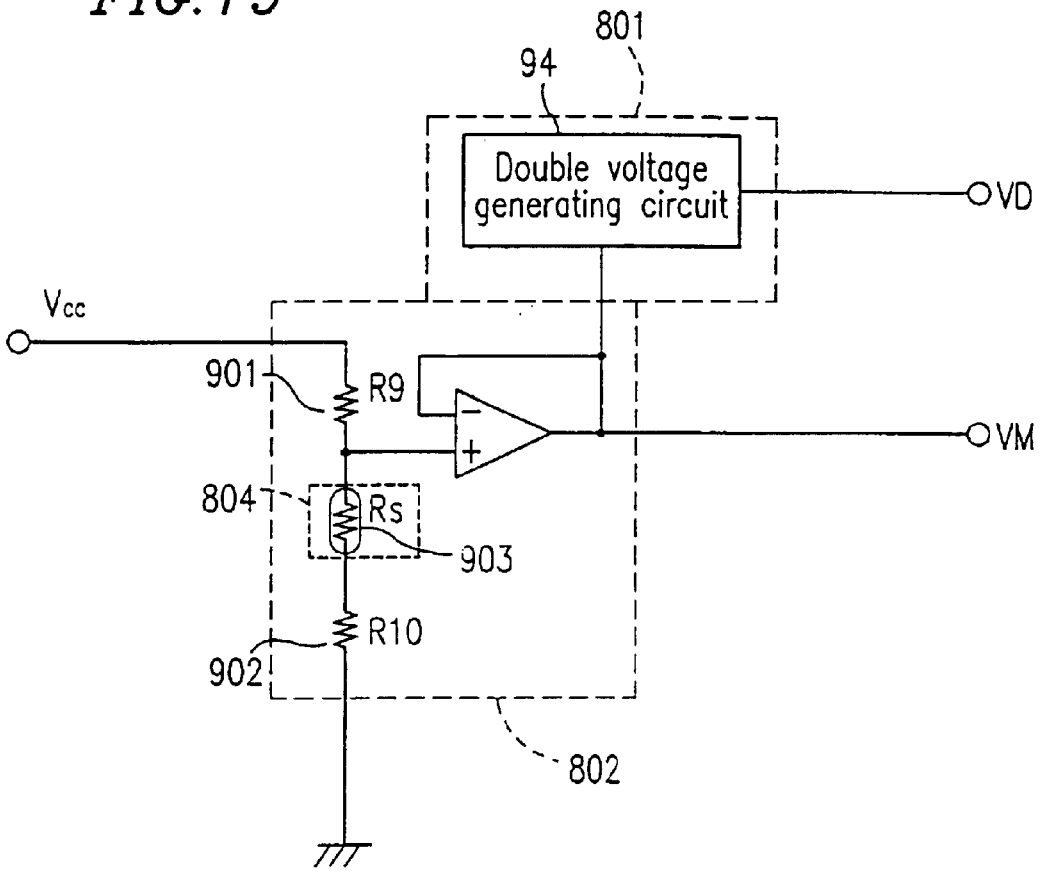
FIG. 19 shows an exemplary circuit configuration of the main voltage generating device shown in FIG. 18.

FIG. 19 is an exemplary circuit configuration of the main voltage generating device 81 shown in FIG. 18.

The non-selection voltage generating circuit 802 has a thermistor 903 which serves as a temperature detection circuit 804. The non-selection voltage VM is obtained by dividing the input logic circuit power-supply voltage $V_{cc}$ in accordance with the resistance ratio between the resistance R9, and the resistances R10 and $R_s$. Here, assuming that the resistances of the resistors 901 and 902 are R9 and R10, respectively, and the resistance of the thermistor 903 is $R_s$, the non-selection voltage VM is represented by the following Expression (9):

$$VM=V_{cc}\times(R_s+R10)/(R9+R_s+R10) \quad (9)$$

Thus, since the resistance $R_s$ of the thermistor 903 is varied depending upon the temperature $T_a$ of the liquid crystal display apparatus, the non-selection voltage VM is therefore varied depending upon the temperature $T_a$ of the liquid crystal display apparatus.

The data signal voltage generating circuit 801 shown in FIG. 19 generates, from the non-selection voltage VM, the data signal voltage VD satisfying the following Expression (10):

$$VD=2\times VM \quad (10)$$

The data signal voltage generating circuit 801 shown in FIG. 19 has a double voltage generating circuit 94. Thus, in the main voltage generating device in the present example, the data signal voltage VD and the non-selection voltage VM can be non-linearly varied depending upon the temperature $T_a$ of the liquid crystal display apparatus, as represented by the curves shown in FIG. 5.

Figure 20:
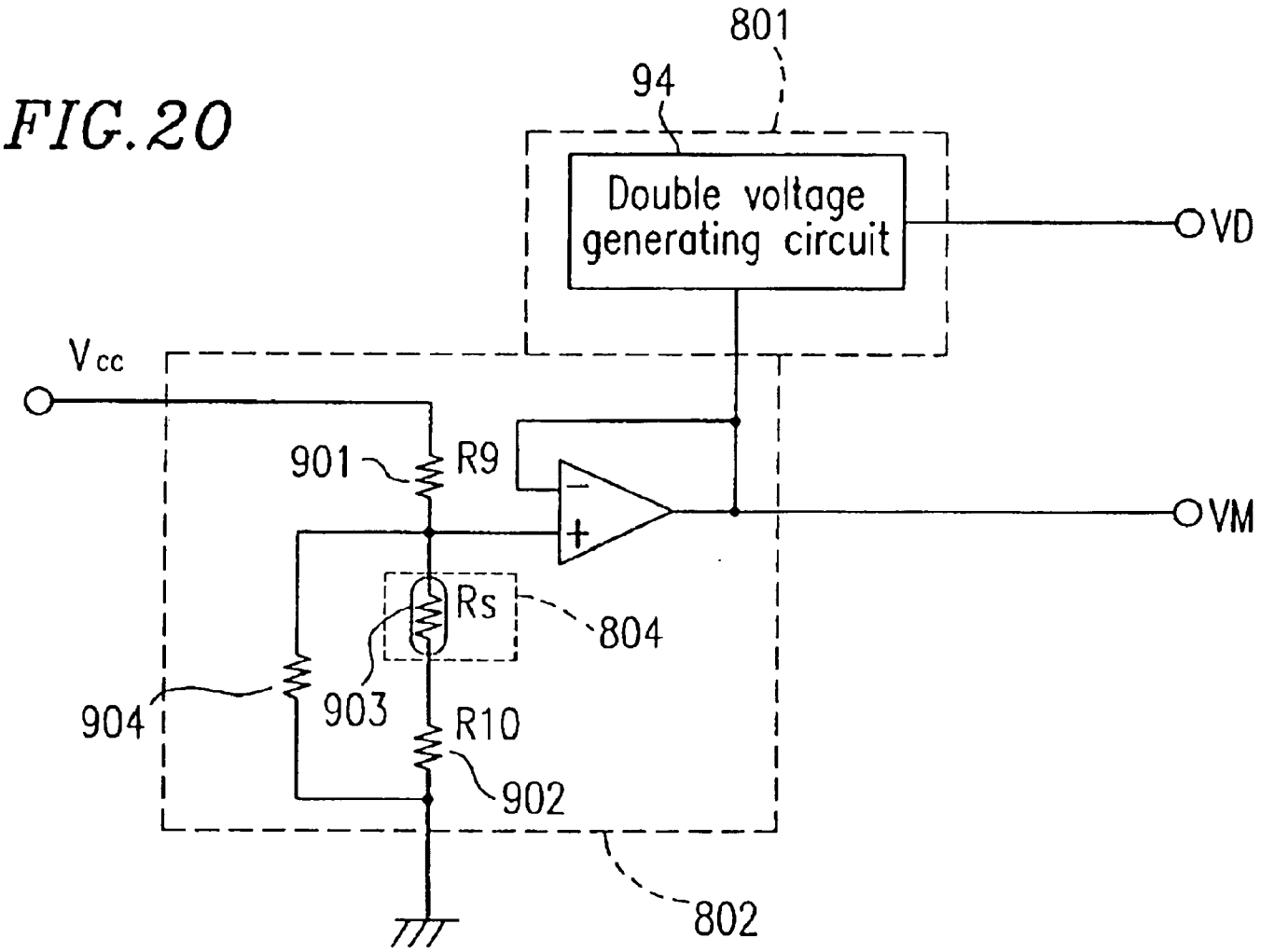
FIG. 20 shows another exemplary circuit configuration of the main voltage generating device in the case where the data signal voltage VD and the non-selection voltage VM are linearly varied depending upon the temperature $T_a$ of the liquid crystal display apparatus.

FIG. 20 shows another exemplary circuit configuration of the main voltage generating device in the case where the data signal voltage VD and the non-selection voltage VM are linearly varied depending upon the temperature $T_a$ of the liquid crystal display apparatus.

In the non-selection voltage generating circuit 802 shown in FIG. 20, the thermistor 903 and the resistor 902 are connected in series to each other, and they are connected in parallel to a resistor 904. In the non-selection voltage generating circuit 802 shown in FIG. 20, the data signal voltage VD and the non-selection voltage VM can be linearly varied depending upon the temperature $T_a$ of the liquid crystal display apparatus, as shown in FIG. 4.

Figure 21:
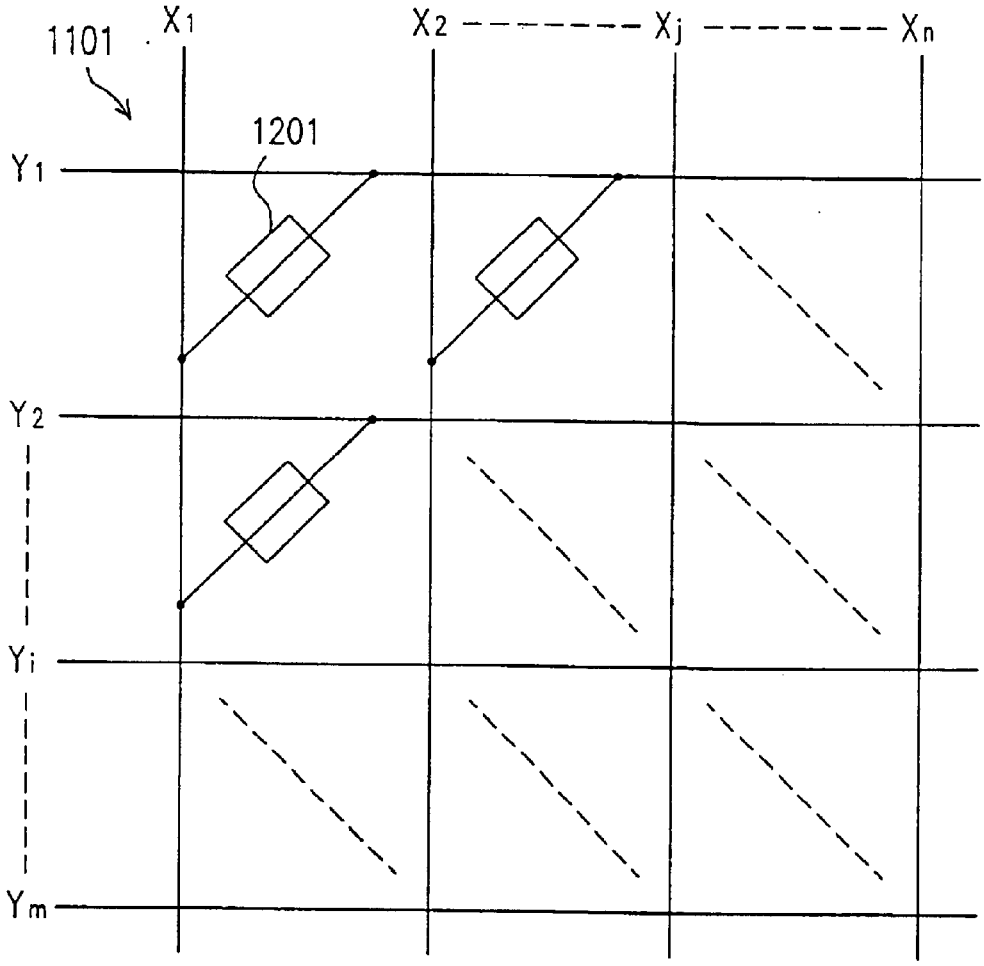
FIG. 21 shows a simple matrix type liquid crystal panel.
Figure 22:
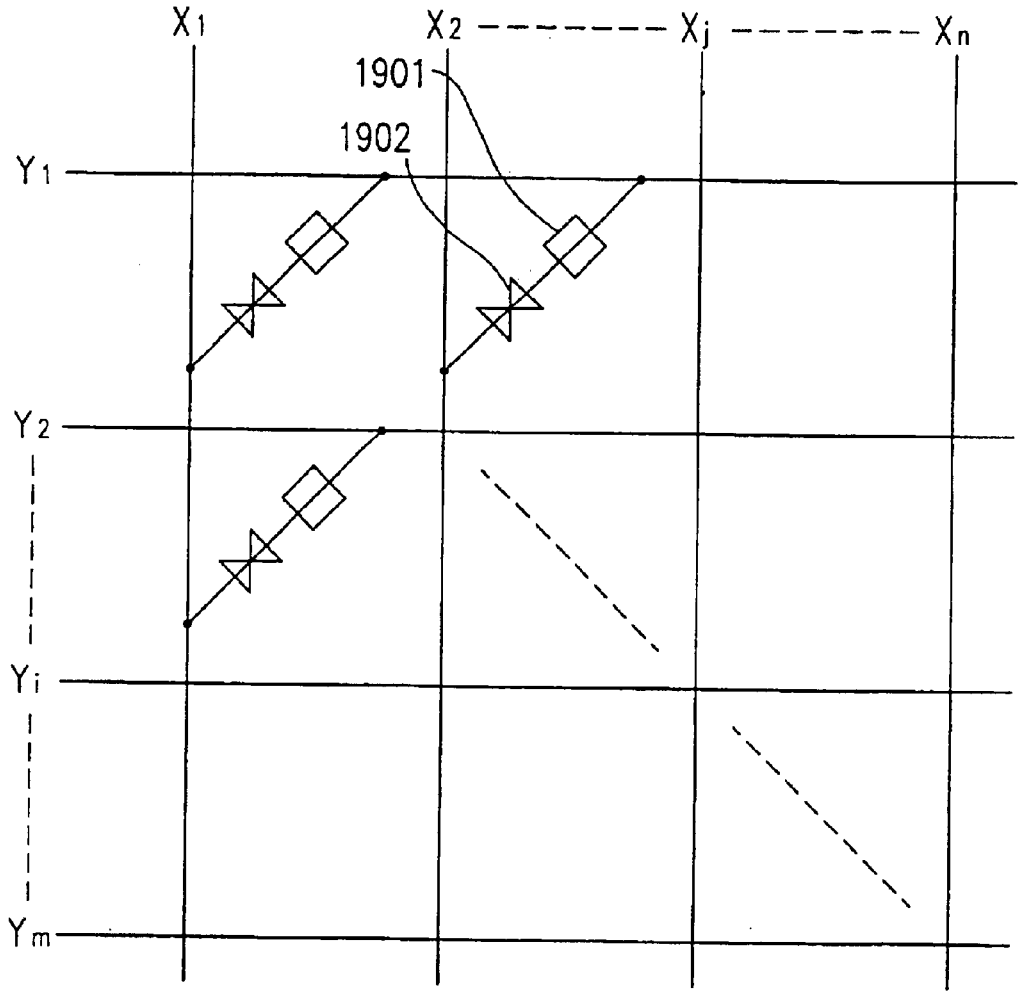
FIG. 22 schematically shows an active matrix type liquid crystal panel.
Figure 23:
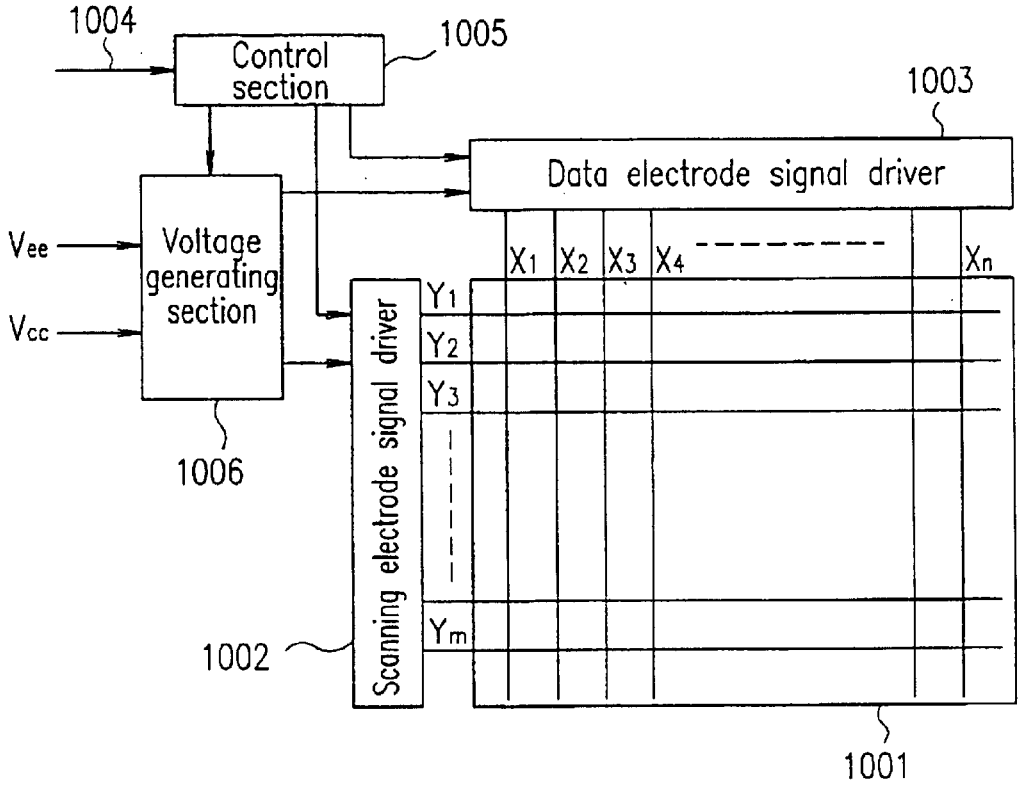
FIG. 23 schematically shows a general liquid crystal display apparatus.
Figure 24:
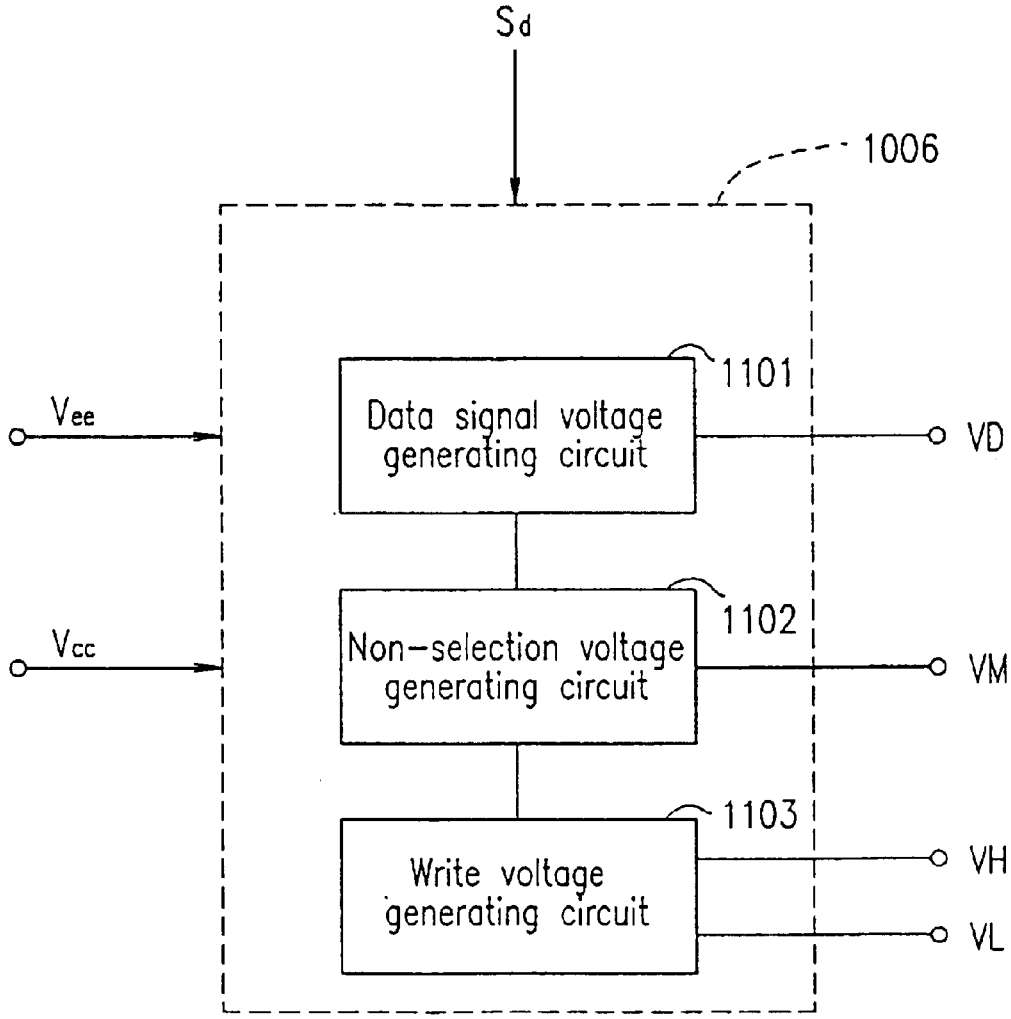
FIG. 24 shows a voltage generating section of the liquid crystal display apparatus shown in FIG. 23.
Figure 25:
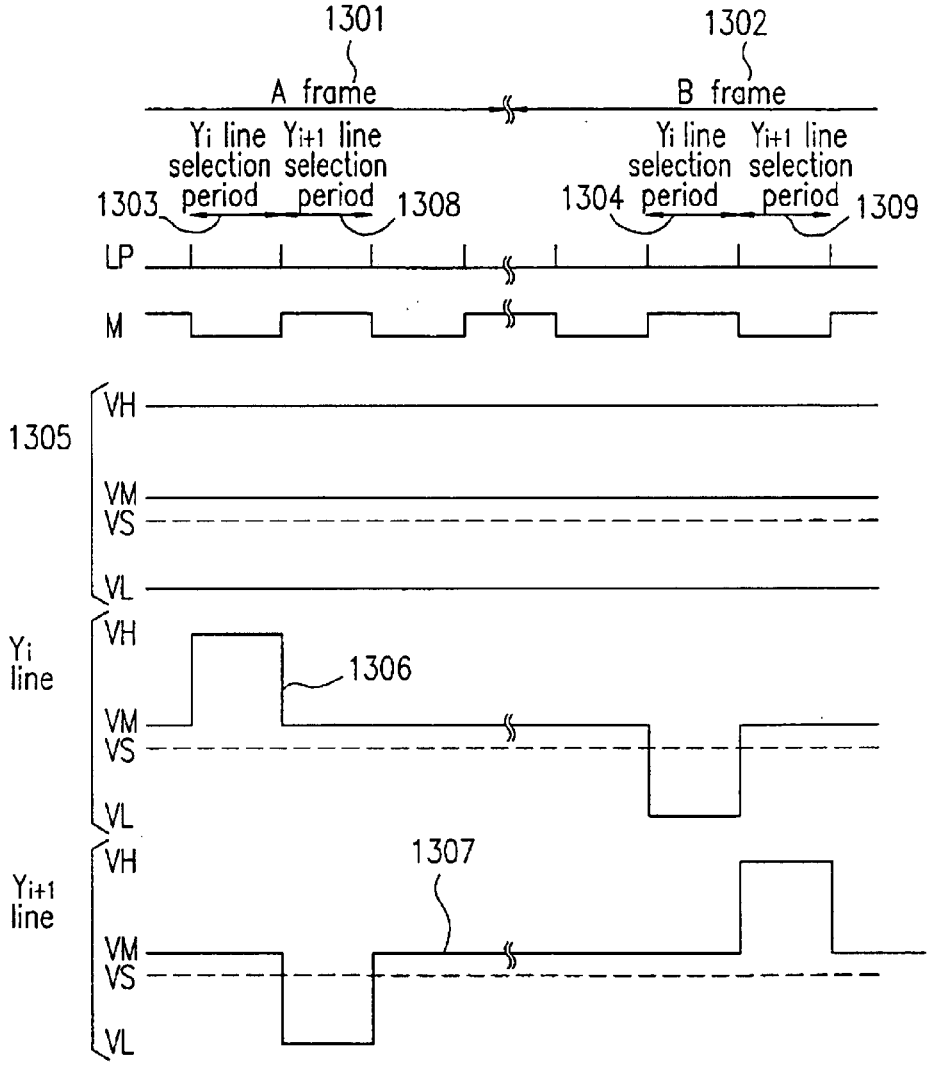
FIG. 25 shows an exemplary operation of a scanning electrode signal driver of the liquid crystal display apparatus shown in FIG. 23.
Figure 26:
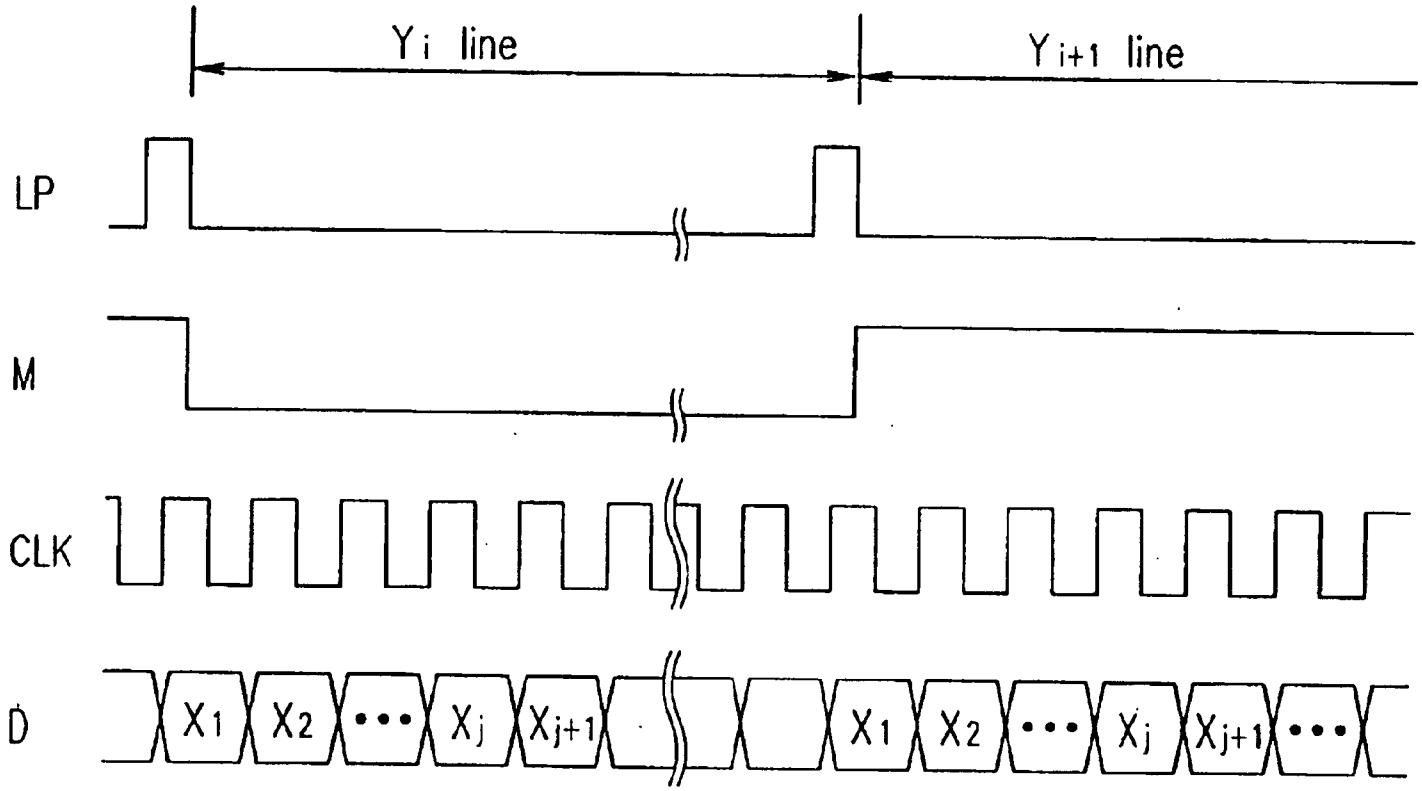
FIG. 26 shows signals transmitted to a data electrode signal driver of the liquid crystal display apparatus shown in FIG. 23.
Figure 27:
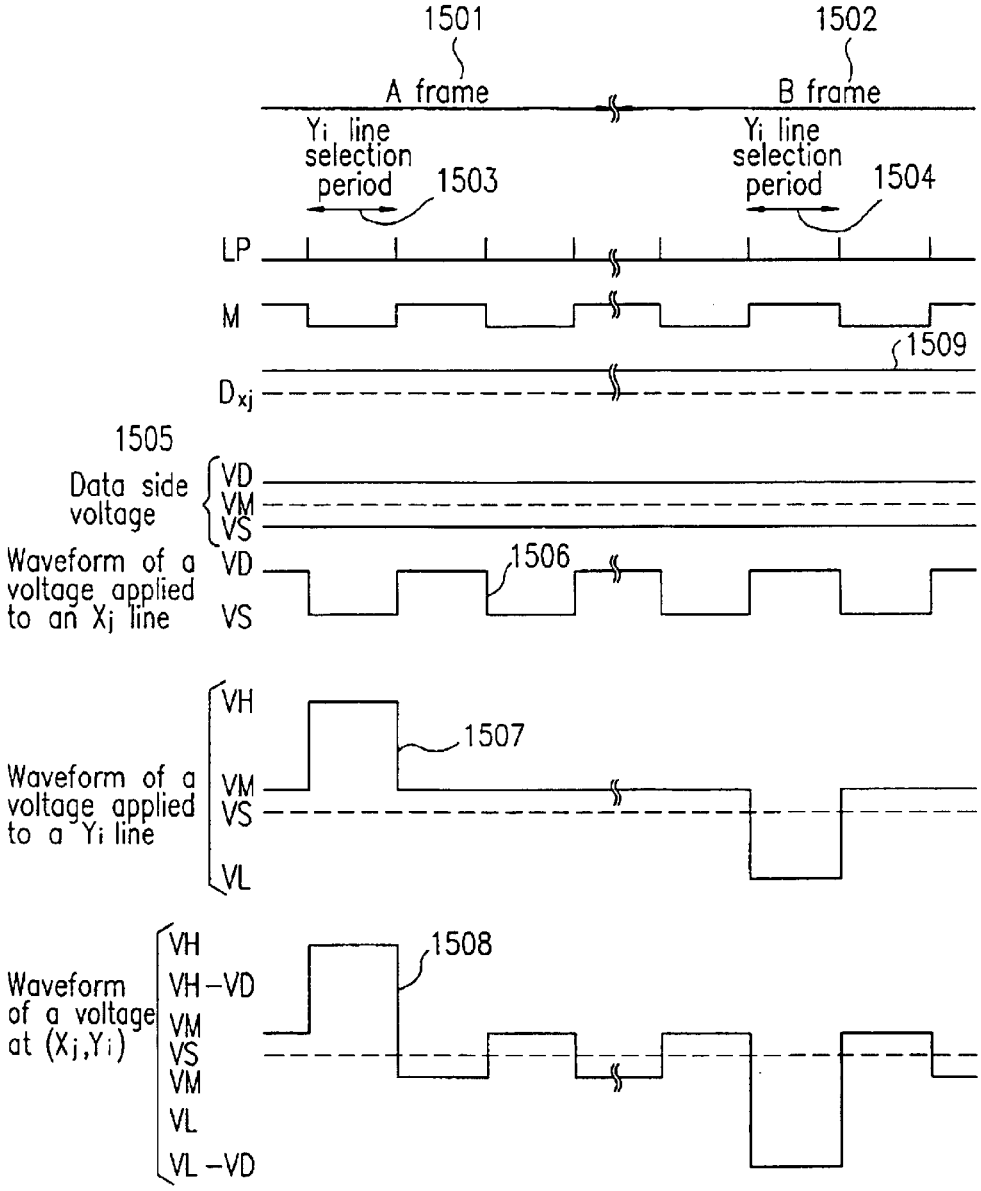
FIG. 27 shows an exemplary operation of the data electrode signal driver of the liquid crystal display apparatus shown in FIG. 23.
Figure 28:
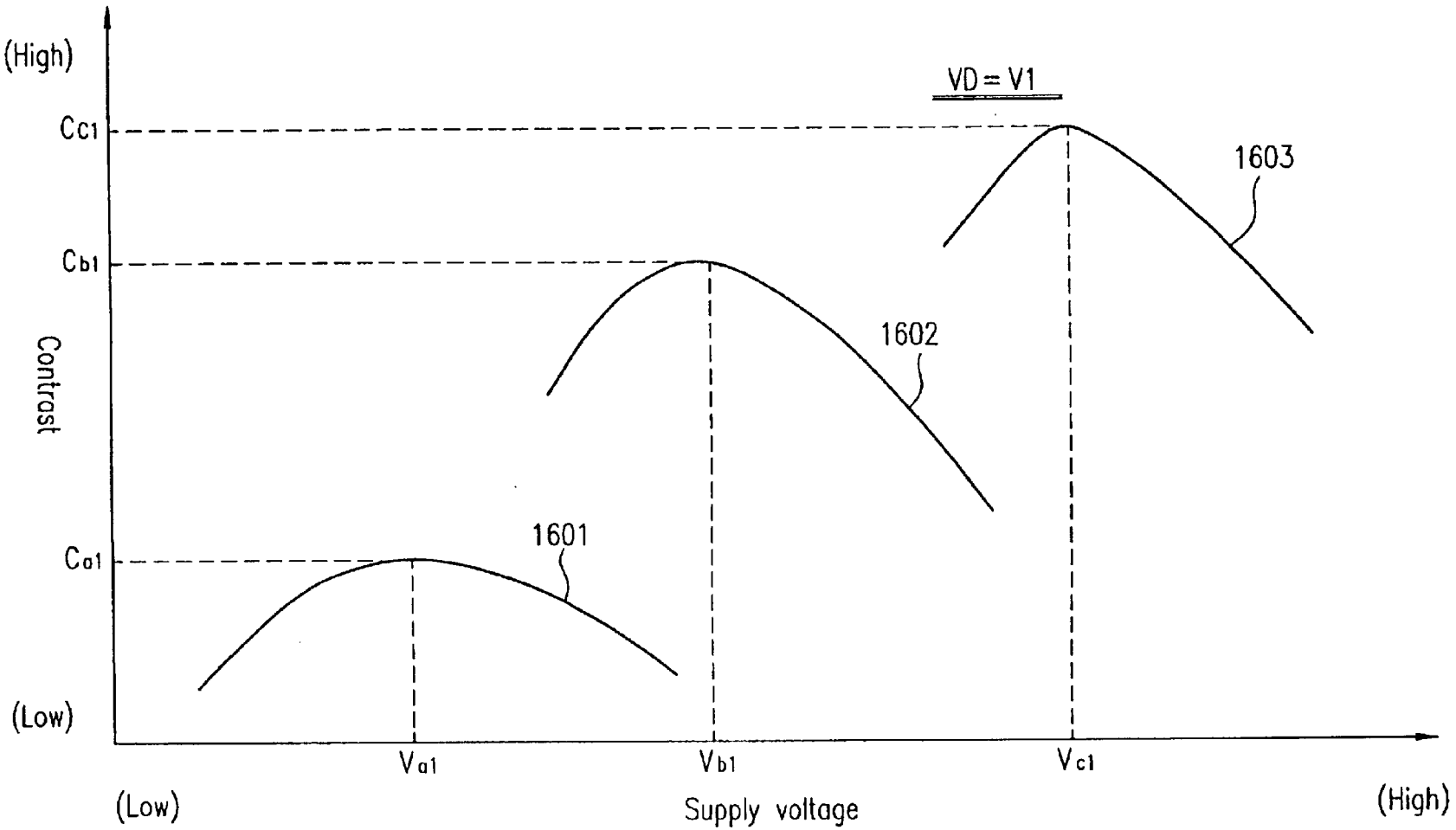
FIG. 28 is a graph showing contrast-supply voltage characteristics.
Figure 29:
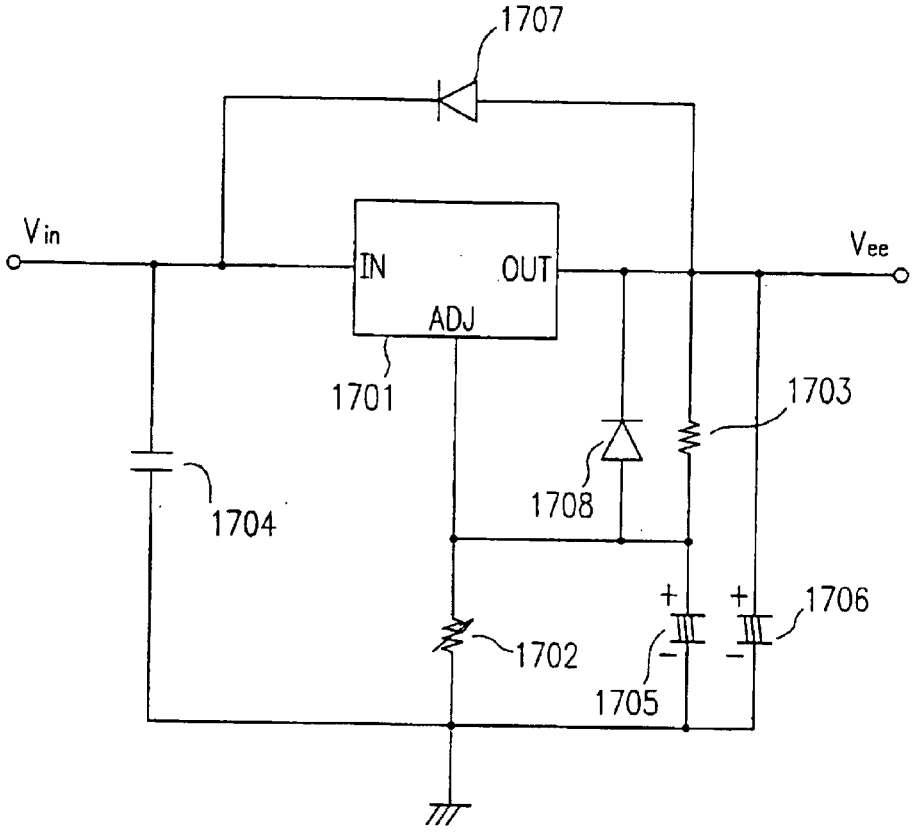
FIG. 29 shows a conventional circuit for generating a power-supply voltage for a liquid crystal driving circuit.

The liquid crystal panel 1101 in the above-mentioned examples is of a simple matrix type as shown in FIG. 21. The liquid crystal panel 1101 in the above-mentioned examples may be of an active matrix type using two-terminal elements as switching elements as shown in FIG. 22. In this case, as the two-terminal element, an MIM or the like can be used.

A structure of a liquid crystal panel including two-terminal elements will be described below.

Pixel electrodes are arranged in a matrix on one of a pair of substrates. A scanning line placed between adjacent pixel electrode lines is connected to each pixel electrode in one pixel electrode line through a two-terminal element. Line-shaped signal electrodes are provided on the other of the liquid crystal substrates so as to cross the pixel electrode lines connected to the scanning lines through the two-terminal elements.

The scanning lines on the liquid crystal panel having the two-terminal elements are supplied with a signal identical with that given to the scanning lines in the case of a simple matrix type liquid crystal display apparatus. The signal lines on the liquid crystal panel having the two-terminal elements are supplied with a signal identical with that given to the data lines in the case of a simple matrix type liquid crystal display apparatus.

Furthermore, the present invention can be applied to a liquid crystal panel having three-terminal elements. A structure of a liquid crystal panel having three-terminal elements will be described below.

Pixel electrodes are provided in a matrix on one of a pair of substrates. Scanning lines and signal lines cross each other, and the scanning lines and the signal lines are arranged between the pixel electrodes. A source electrode of a TFT with its drain electrode connected to each pixel electrode is connected to a signal line, and its gate electrode is connected to a scanning line.

On the other of the substrates, a counter electrode (also called a common electrode) is provided so as to oppose regions where the pixel electrodes are present. In the case of using a liquid crystal panel having three-terminal elements, a signal applied to a gate electrode and a counter electrode is different from that of a simple matrix type liquid crystal display apparatus. However, the signal lines on the liquid crystal panel having the three-terminal elements are supplied with a signal identical with that given to the data electrode lines of the simple matrix type liquid crystal display apparatus.

Furthermore, in the above-mentioned description, the present invention is applied to a liquid crystal display apparatus using liquid crystal as a display medium. However, the present invention is not limited thereto. The present invention can also be applied to a display apparatus using a display medium other than liquid crystal in the same way.

According to the present invention, a data signal voltage is varied depending upon the temperature of a liquid crystal display apparatus, whereby the display apparatus is driven. Therefore, a contrast can be prevented from decreasing. Furthermore, the range of variation of a power-supply voltage such as a power-supply voltage for a liquid crystal driving circuit is decreased. As a result, power consumption is reduced, and a power-supply voltage such as a power-supply voltage for a liquid crystal driving circuit is decreased, whereby a withstanding voltage of components can be decreased.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a liquid crystal display apparatus including pixels, scanning lines, and data lines, comprising the steps of:

generating a data signal voltage to be applied to the data lines from a supply voltage;

measuring a temperature of the liquid crystal display apparatus; and correcting the supply voltage within a narrow variation width of supply voltage values which is based on a display contrast-supply voltage characteristic at the data signal voltage and the temperature of the liquid crystal display apparatus so as to provide a maximum display contrast and minimum power consumption, wherein a temperature dependent variation of a resistance of a thermistor element provides the step of correcting the supply voltage, and wherein a display contrast-temperature characteristic of the liquid crystal display apparatus is used to determine whether the data signal voltage is varied either linearly or non-linearly with temperature.

2. A method for driving a liquid crystal display apparatus according to claim 1, wherein the step of correcting the supply voltage includes:

correcting the supply voltage so that the data signal voltage becomes lower than a reference voltage in a case where the temperature is higher than a first reference temperature.

3. A method for driving a liquid crystal display apparatus according to claim 1, wherein the step of correcting the supply voltage includes:

correcting the supply voltage so that the data signal voltage becomes higher than a reference voltage in a case where the temperature is lower than a first reference temperature.

4. A method for driving a liquid crystal display apparatus according to claim 1, wherein the step of correcting the supply voltage further includes:

correcting the supply voltage to be a first voltage in a case where the temperature is higher than a first reference temperature and correcting the supply voltage to be a second voltage in a case where the temperature is lower than a second reference temperature, wherein the first voltage is lower than the second voltage, and the first reference temperature is higher than the second reference temperature.

5. A method for driving a liquid crystal display apparatus including pixels, scanning lines, and data lines, comprising the steps of:

generating a data signal voltage to be applied to the data lines from a power-supply voltage;

measuring a temperature of the liquid crystal display apparatus; and correcting the data signal voltage within a narrow variation width of supply voltage values which is based on a display contrast-temperature characteristic of the liquid crystal display apparatus so as to provide a maximum display contrast and minimum power consumption, wherein a temperature dependent variation of a resistance of a thermistor element directly provides the step of correcting the data signal voltage, and wherein a display contrast-temperature characteristic of the liquid crystal display apparatus is used to determine whether the data signal voltage is varied either linearly or non-linearly with temperature.

6. A method for driving a liquid crystal display apparatus according to claim 5, wherein the step of correcting the data signal voltage includes:

correcting the data signal voltage to be lower than a reference voltage in a case where the temperature is higher than a first reference temperature.

7. A method for driving a liquid crystal display apparatus according to claim 5, wherein the step of correcting the data signal voltage includes:

correcting the data signal voltage to be higher than a reference voltage in a case where the temperature is lower than a first reference temperature.

8. A method for driving a liquid crystal display apparatus according to claim 5, wherein the step of correcting the data signal voltage further includes:

correcting the data signal voltage to be a first voltage in a case where the temperature is higher than a first reference temperature and correcting the data signal voltage to be a second voltage in a case where the temperature is lower than a second reference temperature, wherein the first voltage is lower than the second voltage, and the first reference temperature is higher than the second reference temperature.

9. A display apparatus comprising:

a display panel including a plurality of scanning lines and a plurality of signal lines;

a scanning line driver for applying a voltage enabling write signal to the scanning lines in a line sequence;

a signal line driver for applying a voltage to the signal lines;

a pre-voltage generating device for generating a supply voltage from an input voltage based on a temperature of the display apparatus, the pre-voltage generating device including a thermistor element; and a main voltage generating device for generating a data signal voltage from the supply voltage to the signal line driver, wherein the supply voltage is generated by the pre-voltage generating device within a narrow variation width of supply voltage values which is based on a display contrast-supply voltage characteristic at the data signal voltage and a variation of a resistance of the thermistor element so as to provide a maximum display contrast and minimum power consumption, the resistance of the thermistor element depends on the temperature of the display apparatus, and a display contrast-temperature characteristic of the liquid crystal display apparatus is used to determine whether the data signal voltage is varied either linearly or non-linearly with temperature.

10. A display apparatus according to claim 9, wherein the pre-voltage generating device increases the supply voltage with a decrease in the temperature of the display apparatus and decreases the supply voltage with an increase in the temperature of the display apparatus.

11. A display apparatus according to claim 9, wherein the pre-voltage generating device includes a temperature detection circuit for measuring the temperature of the display apparatus.

12. A display apparatus comprising:

a display panel including a plurality of scanning lines and a plurality of signal lines;

a scanning line driver for applying a voltage enabling write signal to the scanning lines in a line sequence;

a signal line driver for applying a voltage to the signal lines;

a pre-voltage generating device for generating a supply voltage from a voltage input from outside; and a main voltage generating device for generating a data signal voltage from the supply voltage based on a temperature of the display apparatus and outputting the data signal voltage to the signal line driver, wherein the main voltage generating device includes a thermistor element, the data signal voltage is generated by the main voltage generating device within a narrow variation width of supply voltage values which is directly based on a display contrast-temperature characteristic of the liquid crystal display apparatus and a variation of a resistance of the thermistor element so as to provide a maximum display contrast and minimum power consumption, the resistance of the thermistor element depends on the temperature of the display apparatus, and a display contrast-temperature characteristic of the liquid crystal display apparatus is used to determine whether the data signal voltage is varied either linearly or non-linearly with temperature.

13. A display apparatus according to claim 12, wherein the main voltage generating device increases the data signal voltage with a decrease in the temperature of the display apparatus and decreases the data signal voltage with an increase in the temperature of the display apparatus.

14. A display apparatus according to claim 12, wherein the main voltage generating device includes a temperature detection circuit for measuring the temperature of the display apparatus.

15. A display apparatus according to claim 12, wherein the main voltage generating device includes a non-selection voltage generating circuit, the non-selection voltage generating circuit has a temperature detection circuit for measuring the temperature of the display apparatus, and the non-selection voltage generating circuit generates a non-selection voltage from the supply voltage as the data signal voltage based on the temperature of the display apparatus.

16. A display apparatus according to claim 15, wherein the non-selection voltage generating circuit increases the non-selection voltage with a decrease in the temperature of the display apparatus and decreases the non-selection voltage with an increase in the temperature of the display apparatus.

17. A display apparatus according to claim 9, wherein the display panel is one of a simple matrix type display panel or an active matrix type display panel.

18. A display apparatus according to claim 12, wherein the display panel is one of a simple matrix type display panel or an active matrix type display panel.

19. A liquid crystal display apparatus, comprising:

a data electrode signal driver;

a scanning electrode signal driver;

data lines connected to said data electrode signal driver;

scanning lines connected to said scanning electrode signal driver;

pixels connected to said data lines and said scanning lines;

a main voltage generating circuit for generating a data signal voltage and a non-selection voltage from a supply voltage supplied thereto and outputting the data signal voltage and the non-selection voltage to said data electrode signal driver; and a pre-voltage generating circuit for generating the supply voltage, said pre-voltage generating circuit comprising:
a regulator that outputs the supply voltage; and
a thermistor coupled to a terminal of said regulator, wherein resistance variations of said thermistor due to temperature changes vary a signal at the terminal to adjust a level of the supply voltage output by said regulator within a narrow variation width of supply voltage values which is based on a display contrast-supply voltage characteristic at a data signal voltage so as to provide a maximum display contrast and minimum power consumption, and a display contrast-temperature characteristic of the liquid crystal display apparatus is used to determine whether the data signal voltage and the non-selection voltage are varied linearly or non-linearly with temperature.

20. A display apparatus according to claim 19, further comprising:

a variable resistor coupled to the terminal of said regulator.

21. A liquid crystal display apparatus, comprising:

a data electrode signal driver;

a scanning electrode signal driver;

data lines connected to said data electrode signal driver;

scanning lines connected to said scanning electrode signal driver;

pixels connected to said data lines and said scanning lines;

a main voltage generating circuit for generating a data signal voltage and a non-selection voltage from a supply voltage supplied thereto and outputting the data signal voltage and the non-selection voltage to said data electrode signal driver, said main voltage generating circuit comprising:

an operational amplifier for outputting one of the data signal voltage and the non-selection voltage; and a thermistor coupled to one input of said operational amplifier wherein resistance variations of said thermistor due to temperature changes directly vary a signal at the one input of said operational amplifier to adjust a level of output voltage thereof within a narrow variation width of supply voltage values which is based on a display contrast-temperature characteristic of the liquid crystal display apparatus so as to provide a maximum display contrast and minimum power consumption, and a display contrast-temperature characteristic of the liquid crystal display apparatus is used to determine whether the data signal voltage and the non-selection voltage are varied either linearly or non-linearly with temperature.

22. A display apparatus according to claim 21, further comprising:

a resistor coupled in parallel to said thermistor.

23. A display apparatus according to claim 21, wherein the other of the data signal voltage and the non-selection voltage is generated from the one of the data signal voltage and the non-selection voltage.

24. A method for driving a liquid crystal display apparatus according to claim 1, wherein, in the step of correcting the supply voltage, a decrease in a variation width of the supply voltage is provided by:

at a first measured temperature, correcting the supply voltage so as to provide a first maximum display contrast based on a first display contrast-supply voltage characteristic at a first data signal voltage; and at a second measured temperature, correcting the supply voltage so as to provide a second maximum display contrast based on a second display contrast-supply display voltage characteristic at a second data signal voltage, wherein the first measured temperature is less than the second measured temperature, and the first data signal voltage is greater than the second data signal voltage.

25. A display apparatus according to claim 9, wherein a decrease in a variation width of the supply voltage is provided by:

at a first temperature of the display apparatus, generating the supply voltage so as to provide a first maximum display contrast based on a first display contrast-supply voltage characteristic at a first data signal voltage;

at a second temperature of the display apparatus, generating the supply voltage so as to provide a second maximum display contrast based on a second display contrast-supply voltage characteristic at a second data signal voltage, wherein the first temperature is less than the second temperature, and the first data signal voltage is greater than the second data signal voltage.

26. A display apparatus according to claim 19, wherein a decrease in a variation width of the supply voltage is provided by:

at a first temperature, adjusting the supply voltage so as to provide a first maximum display contrast based on a first display contrast-supply voltage characteristic at a first data signal voltage; and at a second temperature, adjusting the supply voltage so as to provide a second maximum display contrast based on a second display contrast-supply voltage characteristic at a second data signal voltage, wherein the first temperature is less than the second temperature, and the first data signal voltage is greater than the second data signal voltage.

27. A method for driving a liquid crystal display apparatus including pixels, scanning lines, and data lines, comprising:

generating a data signal voltage to be applied to the data lines from a supply voltage;

measuring a temperature of the liquid crystal display apparatus; and correcting the supply voltage so as to change the generated data signal voltage from a reference voltage to one or more other voltages different than the reference voltage, wherein the correcting is based on comparisons involving the measured temperature of the liquid crystal display apparatus with one or more reference temperatures and on display contrast-supply voltage characteristics of the reference voltage and the other voltages at the reference temperatures.

28. The method according to claim 27, wherein the correcting of the supply voltage uses a temperature dependent variation of a resistance of a thermistor element.

29. The method according to claim 27, wherein the display contrast-supply voltage characteristics are used to minimize changes to the supply voltage.

30. A display apparatus comprising:

a display panel including scanning lines and data lines;

data line and signal line drivers;

a main voltage generating circuit for generating a data signal voltage for the data lines from a supply voltage supplied thereto;

a pre-voltage generating circuit for generating the supply voltage and for correcting the supply voltage so as to change the generated data signal voltage from a reference voltage to one or more other voltages different than the reference voltage, wherein the correcting is based on comparisons involving the measured temperature of the liquid crystal display apparatus with one or more reference temperatures and on display contrast-supply voltage characteristics of the reference voltage and the other voltages at the reference temperatures.

31. A method for driving a liquid crystal display apparatus including pixels, scanning lines, and data lines, comprising the steps of:

generating a data signal voltage to be applied to the data lines from a supply voltage;

measuring a temperature of the liquid crystal display apparatus; and correcting the supply voltage so as to change the generated data signal voltage from a reference voltage to a first voltage greater than the reference voltage or a second voltage less than the reference voltage, wherein the correcting is based on display contrast-supply voltage characteristics of the reference voltage and the first and second voltages at first and second reference temperatures and comprises:

comparing the measured temperature with the first reference temperature, if the measured temperature is less than the first reference temperature, correcting the supply voltage so that the data signal voltage is changed to the first voltage;

if the measured temperature is not less than the first reference temperature, comparing the measured temperature with the second reference temperature; and if the measured temperature is greater than the second reference temperature, correcting the supply voltage so that the data signal voltage is changed to the second voltage.

32. The method according to claim 31, wherein the respective peaks of the display contrast-supply voltage characteristics of the first voltage at the first reference temperature and the second voltage at the second reference temperature are closer together than the respective peaks of the display contrast-supply voltage characteristics of the reference voltage at the first and second reference temperatures, whereby a variation width of the power supply voltage is reduced by the correcting of the power supply voltage.

* * * * *